US011151944B2

(12) United States Patent
Hsieh et al.

(10) Patent No.: US 11,151,944 B2
(45) Date of Patent: Oct. 19, 2021

(54) DRIVING CIRCUIT, DISPLAY APPARATUS AND DRIVING METHOD THEREOF

(71) Applicant: Novatek Microelectronics Corp., Hsinchu (TW)

(72) Inventors: Yung-Yu Hsieh, Yunlin County (TW); Tse-Yuan Chen, Miaoli County (TW); Jen-Hao Liao, Hsinchu County (TW); Chun-Hsiao Teng, Hsinchu County (TW); Chia-Wei Chang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/802,578

(22) Filed: Feb. 27, 2020

(65) Prior Publication Data

US 2020/0273409 A1 Aug. 27, 2020

Related U.S. Application Data

(60) Provisional application No. 62/810,959, filed on Feb. 27, 2019.

(51) Int. Cl.
*G09G 3/3266* (2016.01)
*G09G 3/3291* (2016.01)

(52) U.S. Cl.
CPC ..... *G09G 3/3266* (2013.01); *G09G 3/3291* (2013.01); *G09G 2300/0408* (2013.01);
(Continued)

(58) Field of Classification Search
CPC .. G09G 3/3233; G09G 3/3266; G09G 3/3275; G09G 3/3291; G09G 3/3644;
(Continued)

(56) References Cited

U.S. PATENT DOCUMENTS 8,928,640 B2 1/2015 Chang et al.
9,041,453 B2 5/2015 Miyake et al.
(Continued)

FOREIGN PATENT DOCUMENTS

CN 102402959 4/2012
CN 107230454 10/2017
(Continued)

OTHER PUBLICATIONS

"Office Action of Taiwan Counterpart Application", dated Oct. 23, 2020, pp. 1-9.
(Continued)

*Primary Examiner* — Michael J Eurice
(74) *Attorney, Agent, or Firm* — JCIPRNET

(57) ABSTRACT

A driving circuit, a display apparatus and a driving method thereof are provided. The display panel is divided into a plurality of regions including a first region having a rectangular form and a second region having a free form. The driving circuit generates a plurality of control clocks having a first duty cycle during a first period and a second duty cycle different from the first duty cycle during a second period, or having a first phase shift during the first period and a second phase shift different from the first phase shift during the second period, or having a first driving capability during the first period and a second driving capability different from the first driving capability during the second period. Wherein, the control clocks are configured to be transmitted to a gate driving circuit disposed on the display panel for generating a first plurality of scan signals controlling the first region and a second plurality of scan signals controlling the second region according to the control clocks, so as to reduce a luminance difference between the first region and the second region.

15 Claims, 20 Drawing Sheets

(52) U.S. Cl.
CPC ..... *G09G 2310/0221* (2013.01); *G09G 2310/0243* (2013.01); *G09G 2310/08* (2013.01); *G09G 2320/0233* (2013.01)

(58) Field of Classification Search
CPC ..... G09G 3/3674; G09G 2300/0408; G09G 2300/0819; G09G 2310/0221; G09G 2310/0243; G09G 2310/0248; G09G 2310/0251; G09G 2310/06; G09G 2310/08; G09G 2320/0233
See application file for complete search history.

(56) References Cited

U.S. PATENT DOCUMENTS

| | | | |
|---|---|---|---|
| 9,478,187 | B2 | 10/2016 | Miyake et al. |
| 9,881,573 | B2 | 1/2018 | Chang et al. |
| 9,978,329 | B2 | 5/2018 | Miyake et al. |
| 10,460,656 | B2 | 10/2019 | Xi et al. |
| 2002/0075249 | A1 | 6/2002 | Kubota et al. |
| 2007/0040825 | A1 | 2/2007 | Mamba et al. |
| 2011/0199363 | A1 | 8/2011 | Lee et al. |
| 2012/0026156 | A1 | 2/2012 | Chen et al. |
| 2013/0088470 | A1 | 4/2013 | Chang et al. |
| 2014/0300399 | A1 | 10/2014 | Miyake et al. |
| 2015/0077409 | A1 | 3/2015 | Chang et al. |
| 2015/0248869 | A1 | 9/2015 | Miyake et al. |
| 2017/0039976 | A1 | 2/2017 | Miyake et al. |
| 2018/0063466 | A1 | 3/2018 | Bae et al. |
| 2018/0182278 | A1 | 6/2018 | Kim et al. |
| 2018/0190190 | A1 | 7/2018 | Xi et al. |
| 2019/0333433 | A1 | 10/2019 | Zhu et al. |

FOREIGN PATENT DOCUMENTS

| | | |
|---|---|---|
| CN | 107633807 | 1/2018 |
| CN | 107731153 | 2/2018 |
| CN | 107863061 | 3/2018 |
| CN | 108510940 | 9/2018 |
| CN | 108564916 | 9/2018 |
| CN | 108615503 | 10/2018 |
| CN | 108630162 | 10/2018 |
| CN | 108777116 | 11/2018 |
| CN | 108877624 | 11/2018 |
| TW | 201606733 | 2/2016 |
| TW | 201818395 | 5/2018 |

OTHER PUBLICATIONS

"Office Action of Taiwan Counterpart Application", dated Jan. 26, 2021, p. 1-p. 6.
"Office Action of China Counterpart Application", dated Mar. 3, 2021, p. 1-p. 17.
Wo Zhao-Jun, et al., "A Clock Generation Circuit in LCD Driver And Controller", Microelectronics vol. 31. No. 3., Jun. 30, 2001, pp. 216-219.

DRIVING CIRCUIT, DISPLAY APPARATUS AND DRIVING METHOD THEREOF

CROSS-REFERENCE TO RELATED APPLICATION

This application claims the priority benefit of U.S. provisional application Ser. No. 62/810,959, filed on Feb. 27, 2019. The entirety of the above-mentioned patent application is hereby incorporated by reference herein and made a part of this specification.

BACKGROUND

Field of the Invention

The invention relates to a driving circuit, a display apparatus and a driving method thereof, and more particularly, to a driving circuit, a display apparatus and a driving method thereof for displaying images in a free form display panel.

Description of Related Art

FIG. 1 is a schematic diagram illustrating a conventional display panel 10. The display panel 10 has a display region 11, wherein the display region 11 has a pixel array. The driving circuit 100 may drive the display panel 10 to display images. The display driving circuit 100 illustrated in FIG. 1 includes a gate on array (GOA) circuit 110 and a driving circuit 120. The driving circuit 120 is utilized for generating data voltages (a.k.a. data driving signals) for driving pixels on the display panel 10 and also generates control clocks output to the GOA circuit 100. The GOA circuit 110 is disposed on a substrate of the display panel 10 and is as a gate driving circuit utilized for generating scan signals (a.k.a. gate driving signals) according to the control clocks from the driving circuit 120. The GOA circuit 110 may also be referred to as gate in panel (GIP) circuit. The GOA circuit 110 may be disposed on one side or two sides of the display panel 10. The GOA circuit 110 may sequentially scan/drive a plurality of gate lines (also referred to as scan lines) of the pixel array of the display region 11. Based on a scan timing of the GOA circuit 110, the driving circuit 120 may synchronously output the data voltages to a plurality of data lines connecting the pixel array of the display region 11. The display panel 10 may be an organic light emitting diode (OLED) display panel.

Usually, a shape of the display region 11 is a rectangular shape (as illustrated in FIG. 1, for example). In order to conform to an appearance design and a hardware configuration demand, free form display region may be required.

FIG. 2 is a schematic diagram illustrating a display panel having a free form display region. The GOA circuit 110 and the driving circuit 120 illustrated in FIG. 2 may be inferred with reference to the descriptions related to FIG. 1 and thus, will not be repeated. The display region of the display panel illustrated in FIG. 2 includes a free form display region 11*a*, a normal display region 11*b* and a free form display region 11*c*. Because of the free form cutting, loads of the free form display region 11*a*, the normal display region 11*b* and the free form display region 11*c* may be different from each other. Thus, in a condition that a full screen has data corresponding to a same grayscale, a luminance displayed in the free form display region 11*a*, a luminance displayed in the normal display region 11*b* and a luminance displayed in the free form display region 11*c* may probably be different from each another (which ideally should be identical in a normal, rectangular display region). The luminance displayed in the free form display region 11*a* and the luminance displayed in the free form display region 11*c* may be greater than the luminance in the normal display region 11*b*. The display panel that is cut in the free form manner may probably result in non-uniform luminance in each display region, and cause display quality degradation.

In the related art, a panel manufacturer may adopt a physical impedance compensation manner for solving the issue of non-uniform luminance in each display region. Namely, by means of a layout design, an impedance of a display region with less load (i.e., each free form display region) in the display panel is compensated to be identical to an impedance of the normal display region, thereby preventing the display quality degradation caused by the free form cutting.

It should be noted that the content of the section of "Description of Related Art" is used for facilitating the understanding of the invention. A part of the content (or all content) disclosed in the section of "Description of Related Art" may not pertain to the conventional technique known to the persons with ordinary skilled in the art. The content disclosed in the section of "Description of Related Art" does not represent that the content has been known to the persons with ordinary skilled in the art prior to the filing of this invention application.

SUMMARY

The invention provides a driving circuit, a display apparatus and a driving method thereof for reducing a luminance difference between a normal display region and a free form display region in a display panel.

According to an embodiment of the invention, a driving circuit is provided. The driving circuit is used for driving a display panel comprising a plurality of regions, including a first region having a rectangular form and a second region having a free form. The driving circuit includes a timing control circuit. The timing control circuit is used for generating at least a control clock having a first duty cycle during a first period and a second duty cycle different from the first duty cycle during a second period, or having a first phase difference during the first period and a second phase difference different from the first phase difference during the second period, or having a first driving capability during the first period and a second driving capability different from the first driving capability during the second period. Wherein, the at least a control clock is configured to be transmitted to a gate driving circuit disposed on the display panel for generating a first plurality of scan signals controlling the first region and a second plurality of scan signals controlling the second region according to the control clocks, so as to reduce a luminance difference between the first region and the second region.

According to an embodiment of the invention, a driving circuit is provided. The driving circuit is used for driving a display panel comprising a plurality of regions, including a first region having a rectangular form and a second region having a free form. The driving circuit includes a timing control circuit and a data driving circuit. The timing control circuit is used for generating first pixel data corresponding to the first region and second pixel data corresponding to the second region. The data driving circuit is coupled to the timing control circuit. Wherein, the data driving circuit is configured to: generate first data voltages according to the first pixel data and generate second data voltages according to the second pixel data, wherein the second data voltages are being compensated by the data driving circuit or the second pixel data are being compensated by the timing control circuit before outputting to the data driving circuit; or generate a first driving current for driving the first region and generate a second driving current for driving the second region.

According to an embodiment of the invention, a driving circuit is provided. The driving circuit is used for driving a display panel comprising a plurality of regions, including a first region having a rectangular form and a second region having a free form. The driving circuit includes a timing control circuit. The a timing control circuit is used for generating a first synchronization clock having a first duty cycle and a second synchronization clock having a second duty cycle to be transmitted to a gate driving circuit disposed on the display panel. Wherein, the first synchronization clock is configured to generate a first plurality of scan signals controlling the first region of the display panel, and the second synchronization clock is configured to generate a second plurality of scan signals controlling the second region of the display panel, so as to reduce a luminance difference between first region and the second region.

According to an embodiment of the invention, a driving method is provided. The driving method is used for driving a display panel comprising a plurality of regions, including a first region having a rectangular form and a second region having a free form. The driving method includes: generating at least a control clock having a first duty cycle during a first period and a second duty cycle different from the first duty cycle during a second period, or having a first phase difference during the first period and a second phase difference different from the first phase difference during the second period, or having a first driving capability during the first period and a second driving capability different from the first driving capability during the second period. Wherein, the at least a control clock is configured to be transmitted to a gate driving circuit disposed on the display panel for generating a first plurality of scan signals controlling the first region and a second plurality of scan signals controlling the second region according to the control clocks, so as to reduce a luminance difference between the first region and the second region.

According to an embodiment of the invention, a driving method is provided. The driving method is used for driving a display panel comprising a plurality of regions, including a first region having a rectangular form and a second region having a free form. The driving method includes: generating first pixel data corresponding to the first region and second pixel data corresponding to the second region; and performing one of the following, so as to reduce a luminance difference between first region and the second region: (1) generating first data voltages according to the first pixel data and generating second data voltages according to the second pixel data, wherein the second data voltages are being compensated by the data driving circuit or the second pixel data are being compensated by the timing control circuit before outputting to the data driving circuit; and (2) generating a first driving current for driving the first region and generating a second driving current different from the first driving current for driving the second region.

According to an embodiment of the invention, a driving method is provided. The driving method is used for driving a display panel comprising a plurality of regions, including a first region having a rectangular form and a second region having a free form. The driving method includes: generating a first synchronization clock having a first duty cycle and a second synchronization clock having a second duty cycle to be transmitted to a gate driving circuit disposed on the display panel. Wherein, the first synchronization clock is configured to generate a first plurality of scan signals controlling the first region of the display panel, and the second synchronization clock is configured to generate a second plurality of scan signals controlling the second region of the display panel, so as to reduce a luminance difference between first region and the second region.

According to an embodiment of the invention, a display apparatus is provided. The display apparatus includes a display panel, a driving chip and a gate driving circuit. The display panel includes a plurality of regions including a first region having a rectangular form and a second region having a free form. The gate driving circuit is disposed on the display panel. The gate driving circuit is configured to generate a first plurality of scan signals controlling the first region and a second plurality of scan signals controlling the second region according to at least a control clock. The driving chip is coupled to the display panel and the gate driving circuit. The driving chip is configured to generate the at least a control clock having a first duty cycle during a first period and a second duty cycle different from the first duty cycle during a second period, or having a first phase difference during the first period and a second phase difference different from the first phase difference during the second period, or having a first driving capability during the first period and a second driving capability different from the first driving capability during the second period, so as to reduce a luminance difference between the first region and the second region.

To sum up, the display and the driving method thereof provided by the embodiments of the invention can achieve compensating the luminance difference between the free form display region and the normal display region by adjusting one or more of "the duty cycle", "the phase difference", "the drive capability" and "the data voltage corresponding to the same grayscale of each of the driving signals. Thus, the display provided by the embodiments of the invention can reduce the luminance difference between the normal display region and the free form display region in the same display panel.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
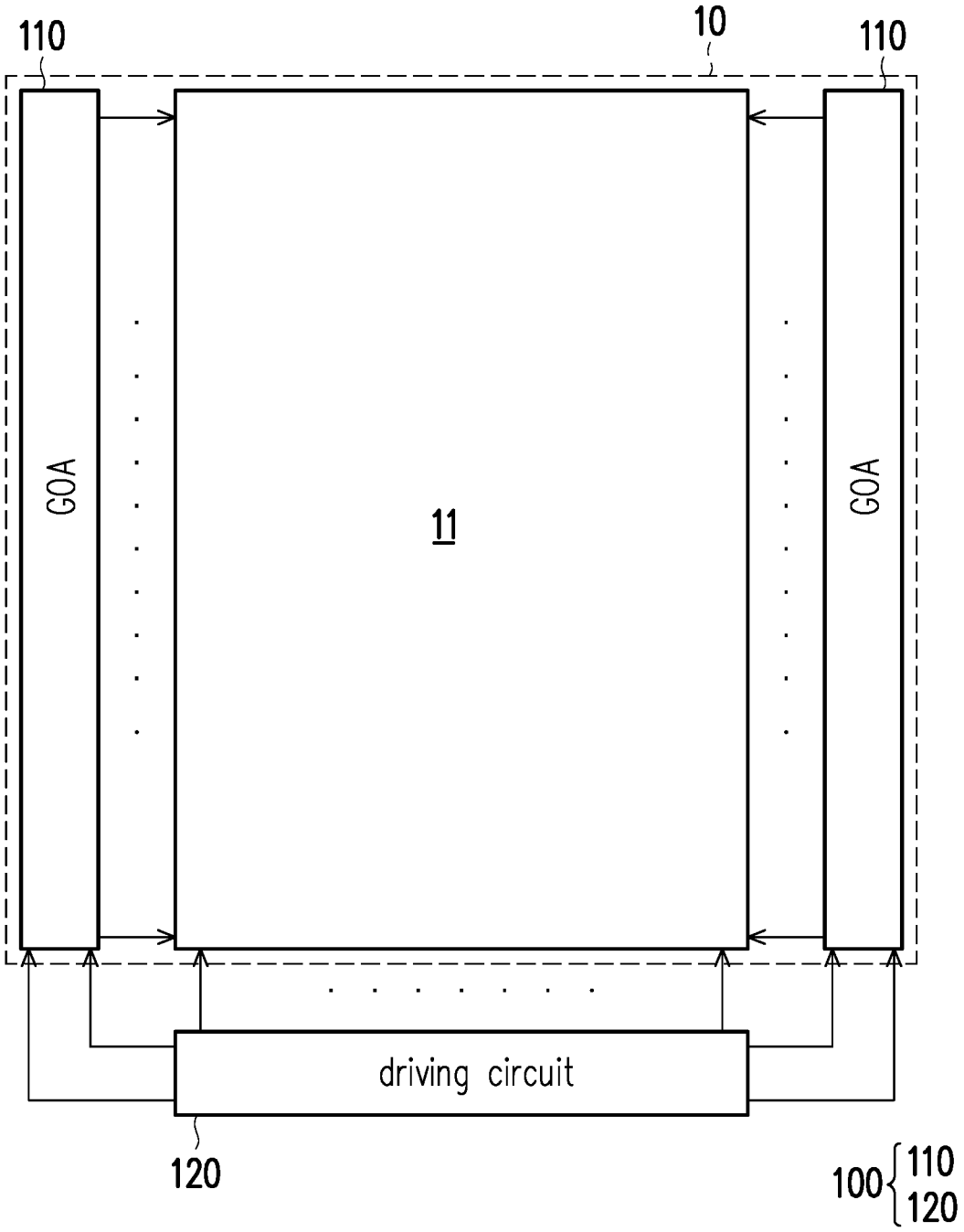
FIG. 1 (RELATED ART)
FIG. 1 is a schematic diagram illustrating a conventional display panel.
Figure 2:
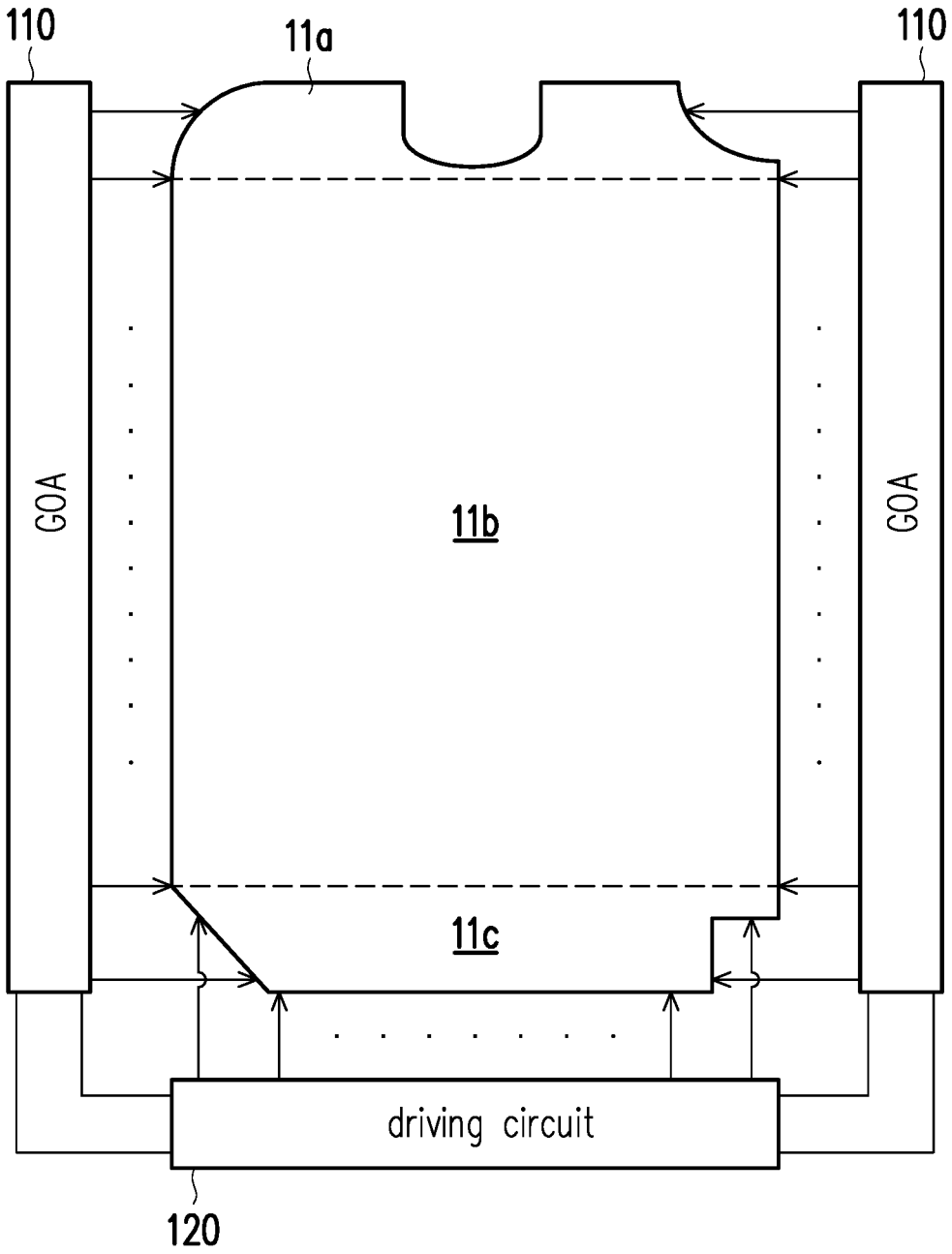
FIG. 2 (RELATED ART)
FIG. 2 is a schematic diagram illustrating a display panel having a free form display region.

A term "couple" used in the full text of the disclosure (including the claims) refers to any direct and indirect connections. For instance, if a first device is described to be coupled to a second device, it is interpreted as that the first device is directly coupled to the second device, or the first device is indirectly coupled to the second device through other devices or connection means. The terms "first" and "second" mentioned in the full text of the specification (including the claims) are used to name the elements, or for distinguishing different embodiments or scopes, instead of restricting the upper limit or the lower limit of the numbers of the elements, nor limiting the order of the elements. Moreover, wherever possible, components/members/steps using the same referral numerals in the drawings and description refer to the same or like parts. Components/members/steps using the same referral numerals or using the same terms in different embodiments may cross-refer related descriptions.

Figure 3A:
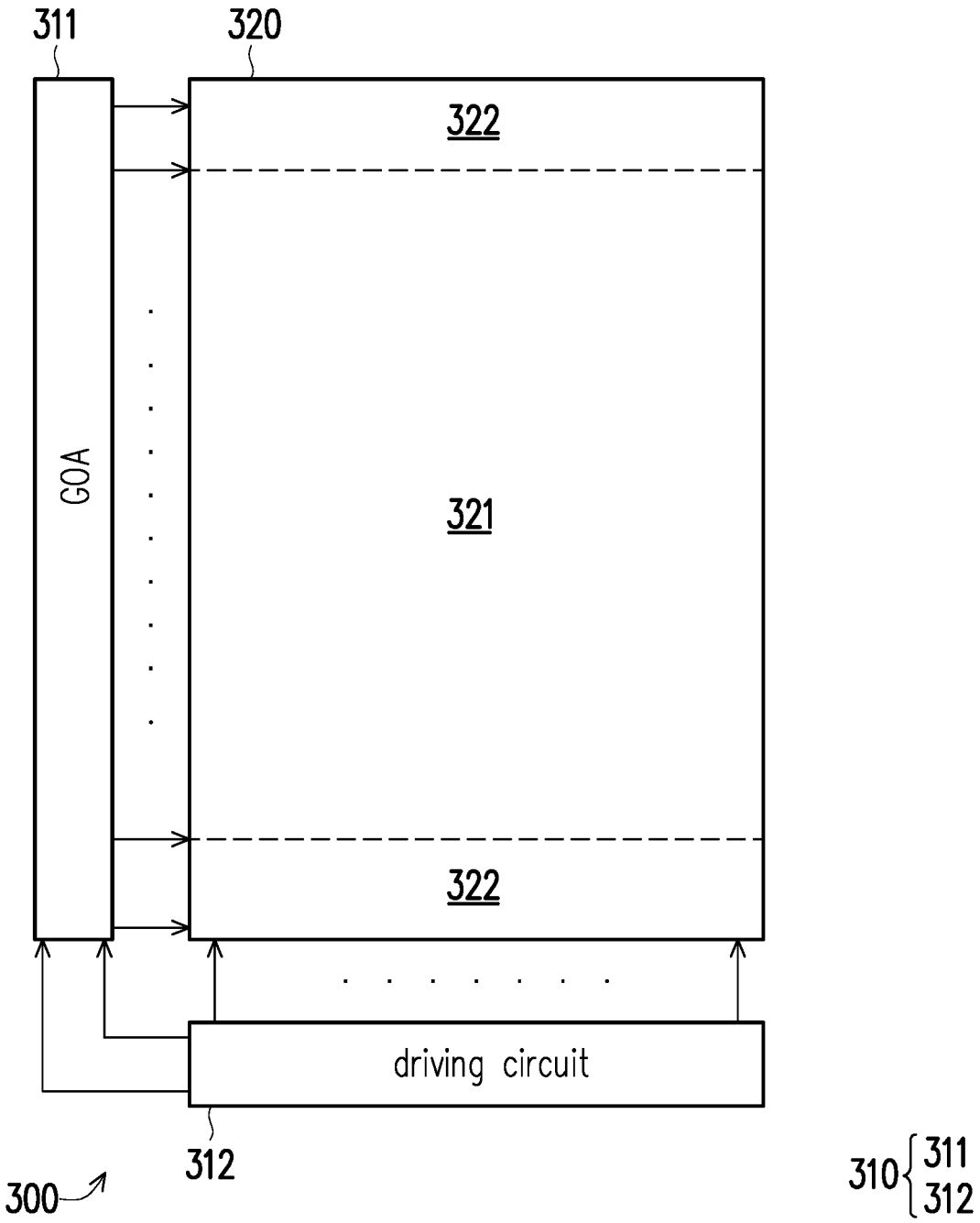
FIG. 3A is a schematic circuit block diagram illustrating a display apparatus according to an embodiment of the invention.
Figure 3B:
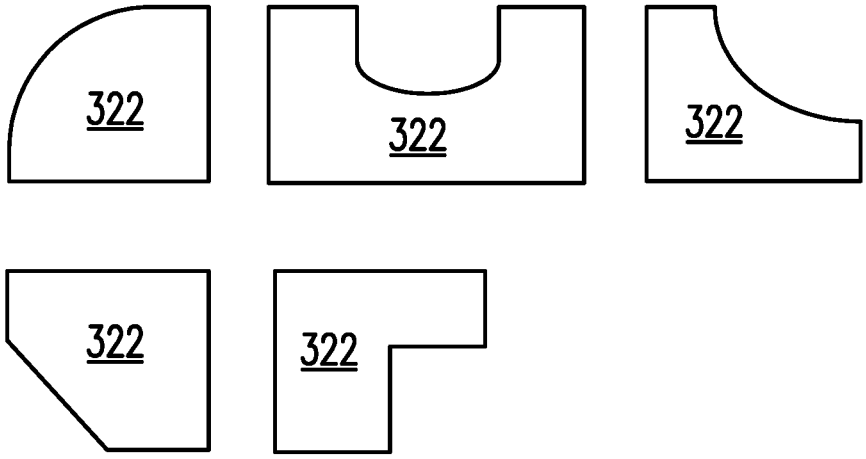
FIG. 3B is a schematic diagram illustrating a variety of geometric shapes that a free form display region may have.

FIG. 3A is a schematic circuit block diagram illustrating a display apparatus 300 according to an embodiment of the invention. The display apparatus 300 illustrated in FIG. 3A includes a driving circuit 310 and a display panel 320. Based on a design requirement, the display panel 320 may be an organic light emitting display (OLED) panel such as an active matrix OLED (AMOLED) display panel. The types of the display panel 320 are not limited to be OLED panel as long as it is manufactured to have a free form, which means the appearance of the display panel 320 is not rectangular as a normal appearance. The display panel 320 may be includes a first display region 321 having a rectangular form, which is called a normal display region hereinafter, and a second display region 322 having a free form, which is called a free form display region hereinafter. Some of possible free forms are depicted in FIG. 3B. FIG. 3B is a schematic diagram illustrating a variety of geometric shapes that a free form display region 322 may have. The free form display region 322 may probably has an R-shaped round corner, C-shaped round corner, U-shaped notch, L-shaped round corner, and/or other geometric shapes. Because of the free form cutting, a load of the free form display region 322 may be probably different from a load of the normal display region 321. Thus, a luminance of the free form display region 322 may be different from a luminance of the normal display region 321 even though displaying image data of the same grayscale. For example, the luminance displayed in the free form display region 322 may be greater than the luminance displayed in the normal display region 321.

Thus, the appearance of the display panel 320 is of a free form and may satisfy with the appearance design requirement of a handheld device such as a mobile phone using the display panel 320. The display panel 320 has a pixel array and is regards as having a plurality of display lines (also called horizontal lines), wherein each display line is a row of pixels.

The driving circuit 310 is coupled to the display panel 320. The driving circuit 310 illustrated in FIG. 3A includes a gate driver on array (GOA) 311 which is a gate driving circuit disposed on a substrate of the display panel 320 and a driving circuit 312 which is a semiconductor chip (usually called driver IC). The driving circuit 312 may output data voltages (a.k.a. data driving signals) to data lines of the display panel 320 to drive the display lines (pixel rows) of the display panel 320 and may output necessary control clocks and control signals to the GOA circuit 311, such that the GOA circuit 311 is able to generate a plurality of scan signals (a.k.a. gate driving signals) and sequentially (i.e. line by line) outputs the scan signals to a plurality of gate lines (also referred to as scan lines) of the display panel 320, to sequentially drive the display lines of the display panel 320. The driving circuit 312 may include a timing control circuit and a data driving circuit. The data voltages are generated by the data driving circuit and the one or more control clocks are generated by the timing control circuit.

Locations for disposing the GOA circuit 311 and the driving circuit 312 may be determined based on a design requirement. For example, in some embodiments, the GOA circuit 311 may be disposed on one side of the pixel array of the display panel 320 to connect the gate lines. In some other embodiments, the GOA 311 may be disposed on two opposite sides of the pixel array of the display panel 320 to connect the gate lines. In some embodiments, the driving circuit 312 may be one driving IC disposed on one side of the pixel array of the display panel 320 to connect the data lines. In some other embodiments, the driving circuit 312 may be two driving ICs respectively disposed on two opposite sides of the pixel array of the display panel 320 to connect the data lines.

Figure 4:
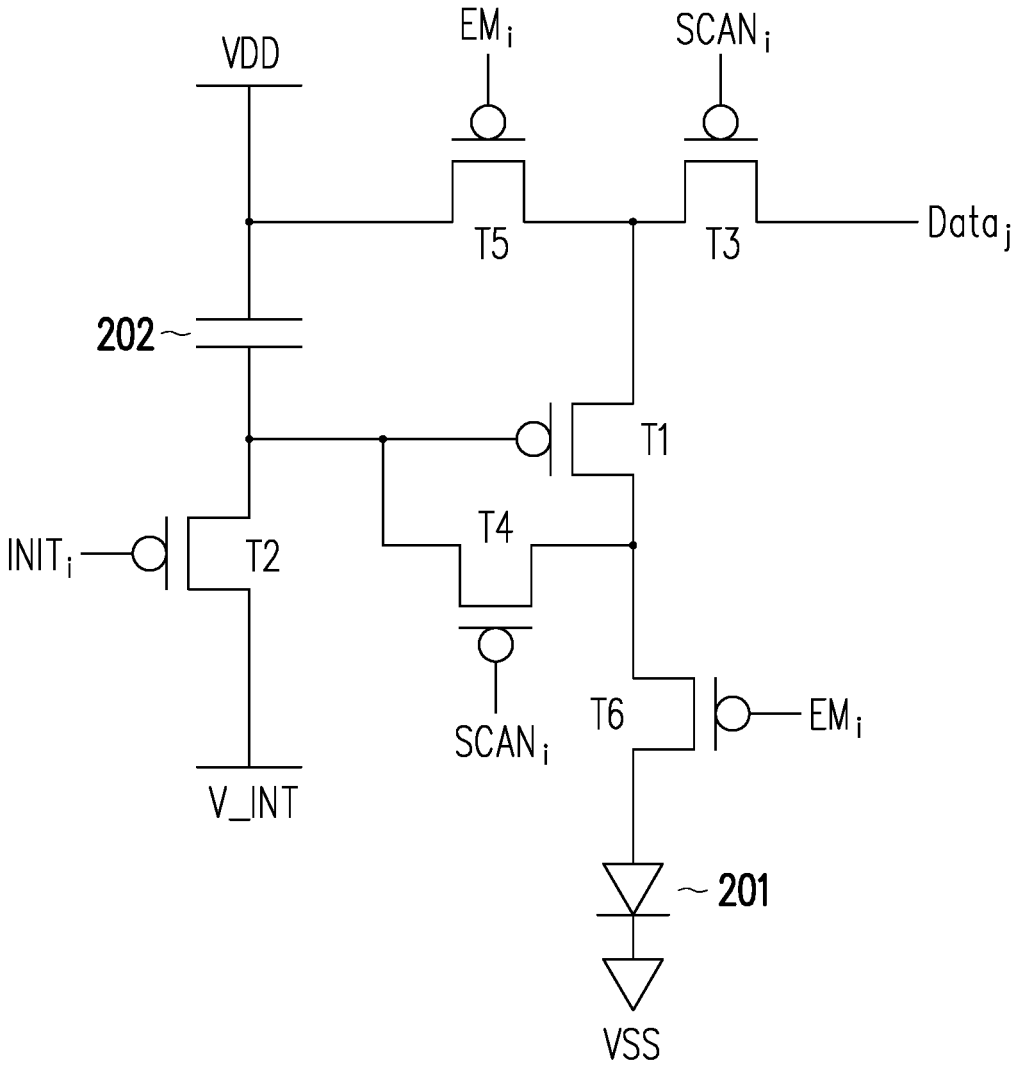
FIG. 4 is a schematic circuit block diagram of an exemplary AMOLED pixel circuit.

FIG. 4 is a schematic circuit block diagram of an exemplary AMOLED (abbreviated to OLED hereinafter) pixel circuit. The OLED pixel circuit of FIG. 4 may be as a pixel circuit of the display panel 320 and includes an OLED 201, a pixel driving circuit formed by 6 p-channel type (p-type) thin film transistors (TFTs) T1-T6, and at least one storage capacitor 202. The electrical conduction states of the p-type TFTs are controlled by the gate driving signals generated by the GOA circuit 311, including a gate scan signal SCANi, an initialization scan signal INITi, and an emission scan signal EMi, wherein i denotes i-th display line. These different gate driving signals are generated based on different types of control clocks output from the driving circuit 312. TFT T1 is a driving transistor that controls a driving current to the OLED 201 and T6 is an emission control transistor that controls the emission period of the OLED 201.

Figure 5:
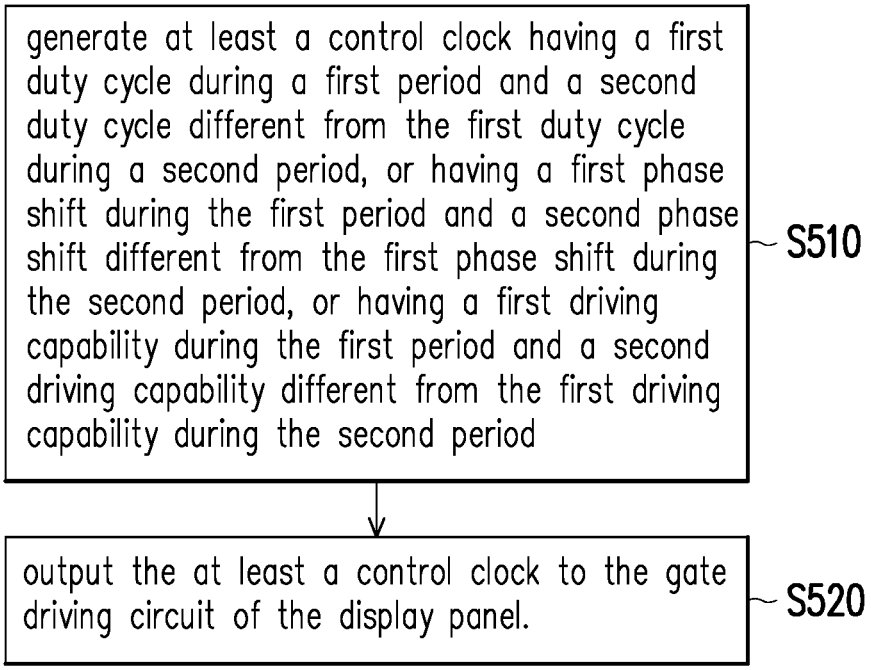
FIG. 5 is a flowchart illustrating a driving method of a driving circuit according to an embodiment of the invention.

FIG. 5 is a flowchart illustrating a driving method of a driving circuit according to an embodiment of the invention. The driving method of FIG. 5 may be implemented in the driving circuit 312 and thereby the following is described in view of the driving circuit 312. In step S510, the driving circuit 312 (and more specifically, the timing control circuit of the driving circuit 312) may generate at least a control clock, and the at least a control clock may has a first duty cycle during a first period and a second duty cycle different from the first duty cycle during a second period, which may be referred to CLK1 and CLK2 depicted in FIG. 6 as an example; or, the at least a control clock may has a first phase difference during the first period and a second phase difference different from the first phase difference during the second period, which may be referred to CLK1 and CLK2 depicted in FIG. 7 as an example; or, the at least a control clock may have a first driving capability during the first period and a second driving capability different from the first driving capability during the second period which may be referred to CLK depicted in FIG. 11 as an example. In step S520, the driving circuit 312 may output the at least a control clock to the GOA circuit 311 of the display panel 320. Thereby, the GOA circuit 311 may generate a first plurality of scan signals controlling the first display region (as normal display region 321) and a second plurality of scan signals controlling the second display region (as a free form display region 322) according to the at least a control clock, so as to reduce a luminance difference between the first display region and the second display region.

Figure 6:
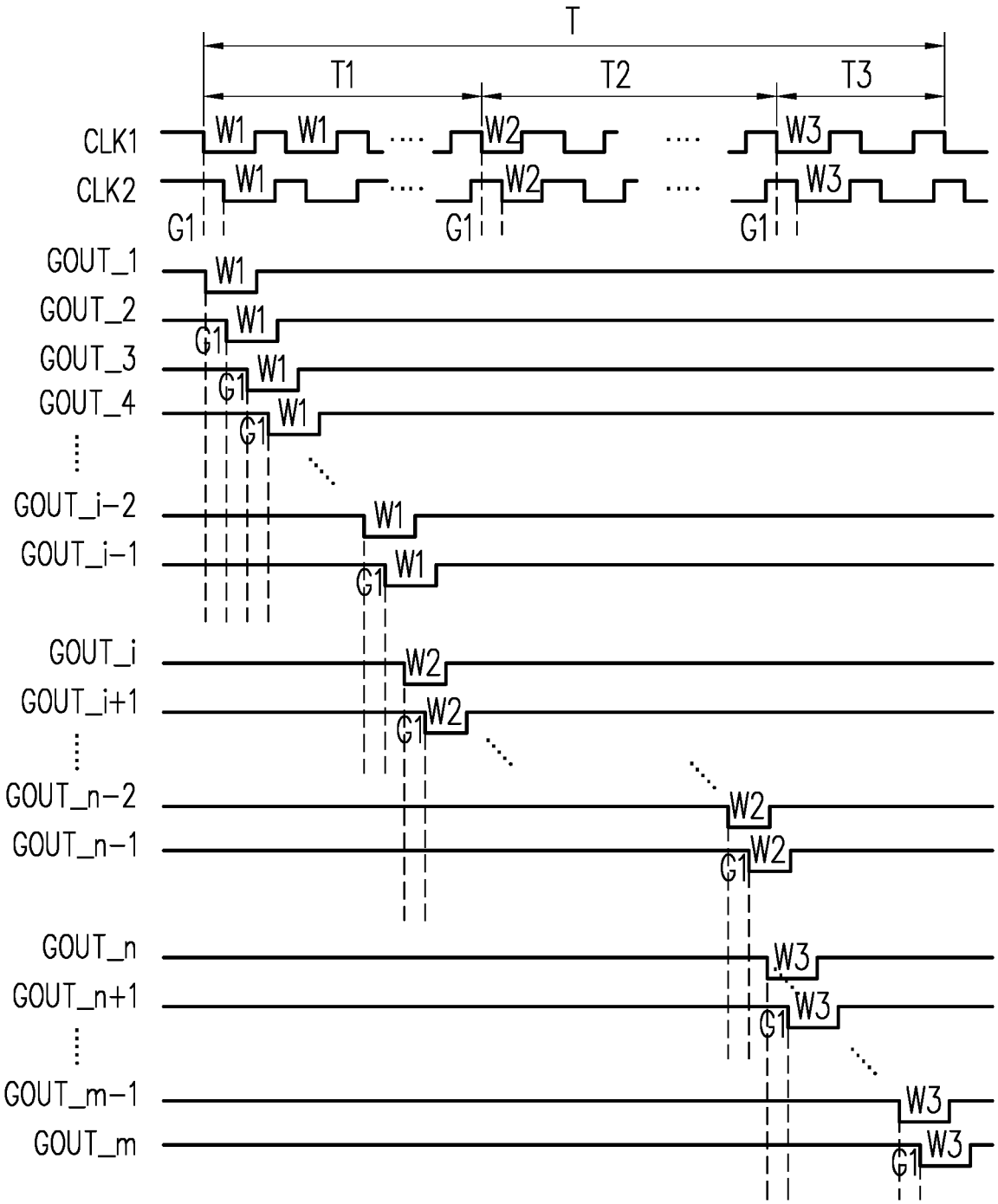
FIG. 6 is a schematic timing diagram illustrating two control clocks generated by the driving circuit and scan signals (i.e., the gate driving signals) output by the GOA circuit according to an embodiment of the invention.

FIG. 6 is a schematic timing diagram illustrating two control clocks CLK1 and CLK2 generated by the driving circuit 312 and scan signals (i.e., the gate driving signals) output by the GOA 311 according to an embodiment of the invention. In FIG. 6, the horizontal axis represents the time, and the vertical axis represents the signal level. GOUT_1, GOUT_2, GOUT_3, GOUT_4, . . . , GOUT_i−2 and GOUT_i−1 illustrated in FIG. 6 represent scan signals output to the free form display region 322 (second display region) by the GOA 311, GOUT_i, GOUT_i+1, . . . , GOUT_n−2 and GOUT_n−1 illustrated in FIG. 6 represent scan signals output to the normal display region 321 (first display region) by the GOA 311, and GOUT_n, GOUT_n+1, . . . , GOUT_m−1 and GOUT_m illustrated in FIG. 6 represent scan signals output to another free form display region 322 (another second display region) by the GOA 311. More specifically, a plurality of scan signals for a display region are output to gate lines of the display region to sequentially drive display lines of the display region. Referring to the exemplary OLED pixel circuit of FIG. 3C, the scan signal may be SCANi controlling the TFTs T3 and T4.

In the embodiment illustrated in FIG. 6, the driving circuit 312 may generate control clocks CLK1 and CLK2, and both of them have a first duty cycle during a period T1, a second duty cycle during a period T2 and a third duty cycle during a period T3. The first duty cycle and the third duty cycle are different from the second duty cycle, and are used when the control clocks are supplied to generate scan signals of the free form display regions 322, thereby compensating the luminance difference between the free form display regions 322 and the normal display region 321. The scan signals may be generated based on the control clocks and a start pulse, by using shift register circuit of the GOA circuit 311. Anyone of the first duty cycle and the third duty cycle may be configured to be smaller or larger than the second duty cycle based on the loading condition of the free form display region (which may be less or greater than the loading of the normal display region). Different duty cycles may result in different pulse widths (i.e. the length of active period). The first duty cycle results in a pulse width W1, the second duty cycle results in a pulse width W2, and the third duty cycle results in a pulse width W3. The different pulse widths may be preconfigured by values store in registers of the driving circuit 312. Taking the signal waveform diagram illustrated in FIG. 6 for example, the pulse width of each of the scan signals GOUT_1 through GOUT_i−1 output to the free form display region 322 is W1, the pulse width of each of the scan signals GOUT_i through GOUT_n−1 output to the normal display region 321 is W2, and the pulse width of each of the scan signals GOUT_n through GOUT_m output to another free form display regions 322 is W3. The pulse widths W1, W2 and W3 may be determined based on a design requirement, and the pulse width W1 and the pulse width W3 are different from (i.e. smaller or larger than) the pulse width W2. Based on the geometric shape in which the free form display regions 322 is cut, the pulse width W1 may be different from the pulse width W3, or alternatively, the pulse width W1 may be identical to the pulse width W3. Among the scan signals GOUT_1 through GOUT_m illustrated in FIG. 6, a phase difference between each two adjacent scan signals is G1, wherein the phase difference G1 may be determined based on a design requirement. It is noted that two control clocks are an example, and for another embodiment which also controls the duty cycle of the control clock, the GOA circuit 311 may be capable of generating all the scan signals (SCAN) of the display lines according to only one control clock based on the circuit design of the GOA circuit 311.

Figure 7:
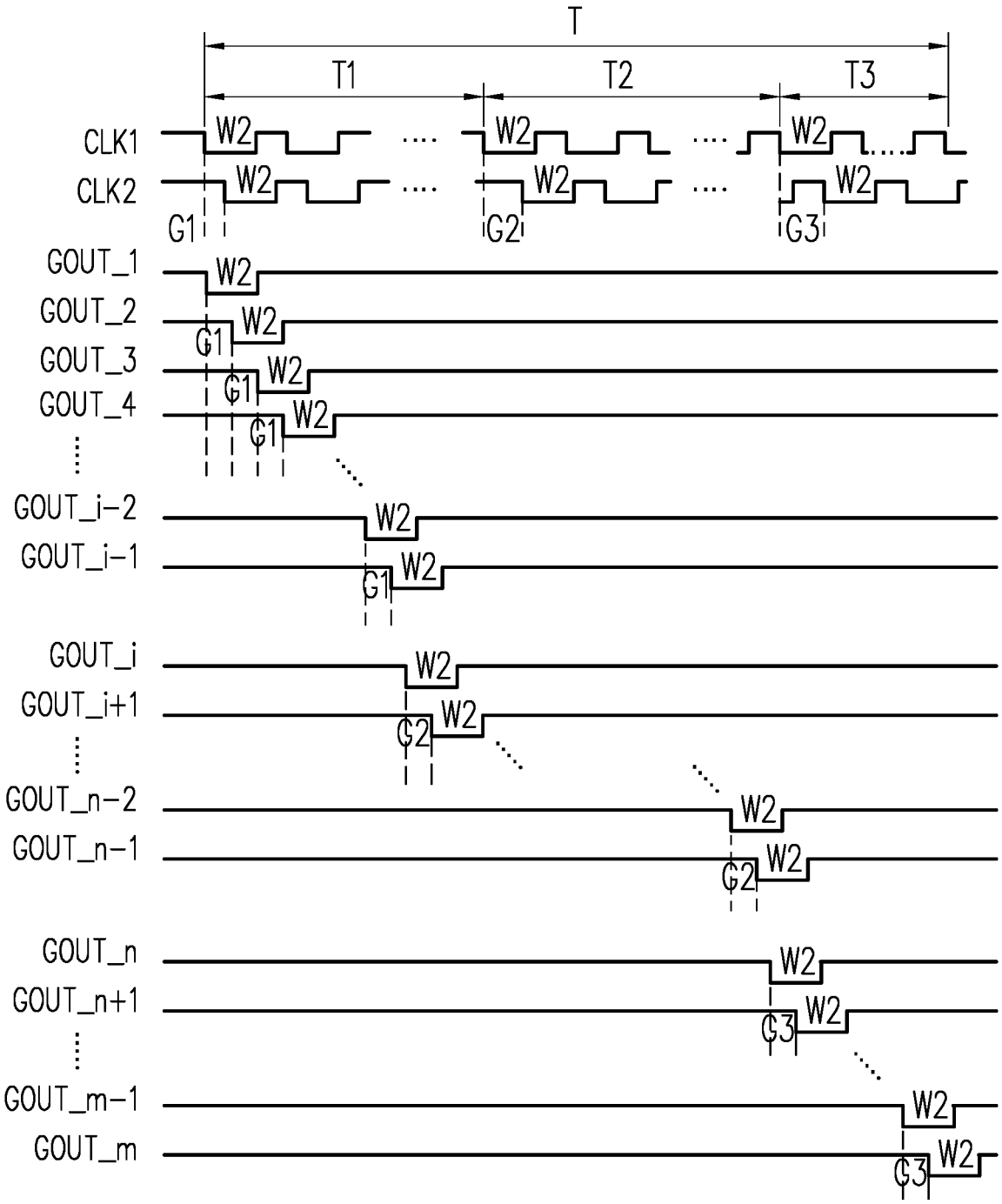
FIG. 7 is a schematic timing diagram illustrating two control clocks generated by the driving circuit and scan signals (i.e., the driving signals) output by the GOA circuit according to another embodiment of the invention.

FIG. 7 is a schematic timing diagram illustrating two control clocks CLK1 and CLK2 generated by the driving circuit 312 and scan signals (i.e., the driving signals) output by the GOA 311 according to another embodiment of the invention. In FIG. 7, the horizontal axis represents the time, and the vertical axis represents the signal level. The scan signals GOUT_1 through GOUT_m illustrated in FIG. 7 may be inferred with reference to the descriptions related to the GOUT_1 through GOUT_m illustrated in FIG. 6 and thus, will not be repeated. In the embodiment illustrated in FIG. 7, the pulse width of each of the scan signals GOUT_1 through GOUT_m is the same and denoted by W2. The pulse width W2 may be determined based on a design requirement. More specifically, a plurality of scan signals for a display region are output to gate lines of the display region to sequentially drive display lines of the display region.

Referring to the exemplary OLED pixel circuit of FIG. 3C, the scan signal may be SCANi controlling the TFTs T3 and T4.

In the embodiment illustrated in FIG. 7, the driving circuit 312 may generate control clocks CLK1 and CLK2. CLK1 has a first phase shift (referring to a reference clock, not shown in FIG. 7), and CLK2 has a second phase shift (referring to the same reference clock), and CLK1 and CLK2 have a first phase difference G1 (between CLK1 and CLK2) during a period T1. CLK1 has a third phase shift (referring to the same reference clock), and CLK2 has a fourth phase shift (referring to the same reference clock), and CLK1 and CLK2 have a second phase difference G2 during a period T2. Similarly, CLK1 and CLK2 have a third phase difference G3 during a period T3. The first phase difference and the third phase difference are different from the second phase difference. Registers in the driving circuit 312 may be used for storing different clock delay values, which determine difference phase shifts (referring to the reference clock) such that the phase difference between CLK1 and CLK2 is determined. Different phase shifts for the control clocks may result in phase different between the control clocks, and different phase differences of the scan signals, thereby compensating the luminance difference between the free form display regions 322 and the normal display region 321. Anyone of the first phase difference G1 and the third phase difference G3 may be configured to be smaller or larger than the second phase difference based on the loading condition of the free form display region (which may be less or greater than the loading of the normal display region). The phase difference refers to a difference between a phase of a current scanning signal and a phase of its adjacent previous scanning signal. In an embodiment using only one control clock to generate all scan signals, the phase difference may be as the phase shift of the control clock. Taking the signal waveform diagram illustrated in FIG. 7 for example, the phase differences of the scan signals GOUT_1 through GOUT_i−1 output to the free form display region 322 are G1, and the phase difference of each of the scan signals GOUT_i through GOUT_n−1 output to the normal display region 321 is G2, and the phase differences of the scan signals GOUT_n through GOUT_m output to another free form display region 322 are G3.

Figure 8:
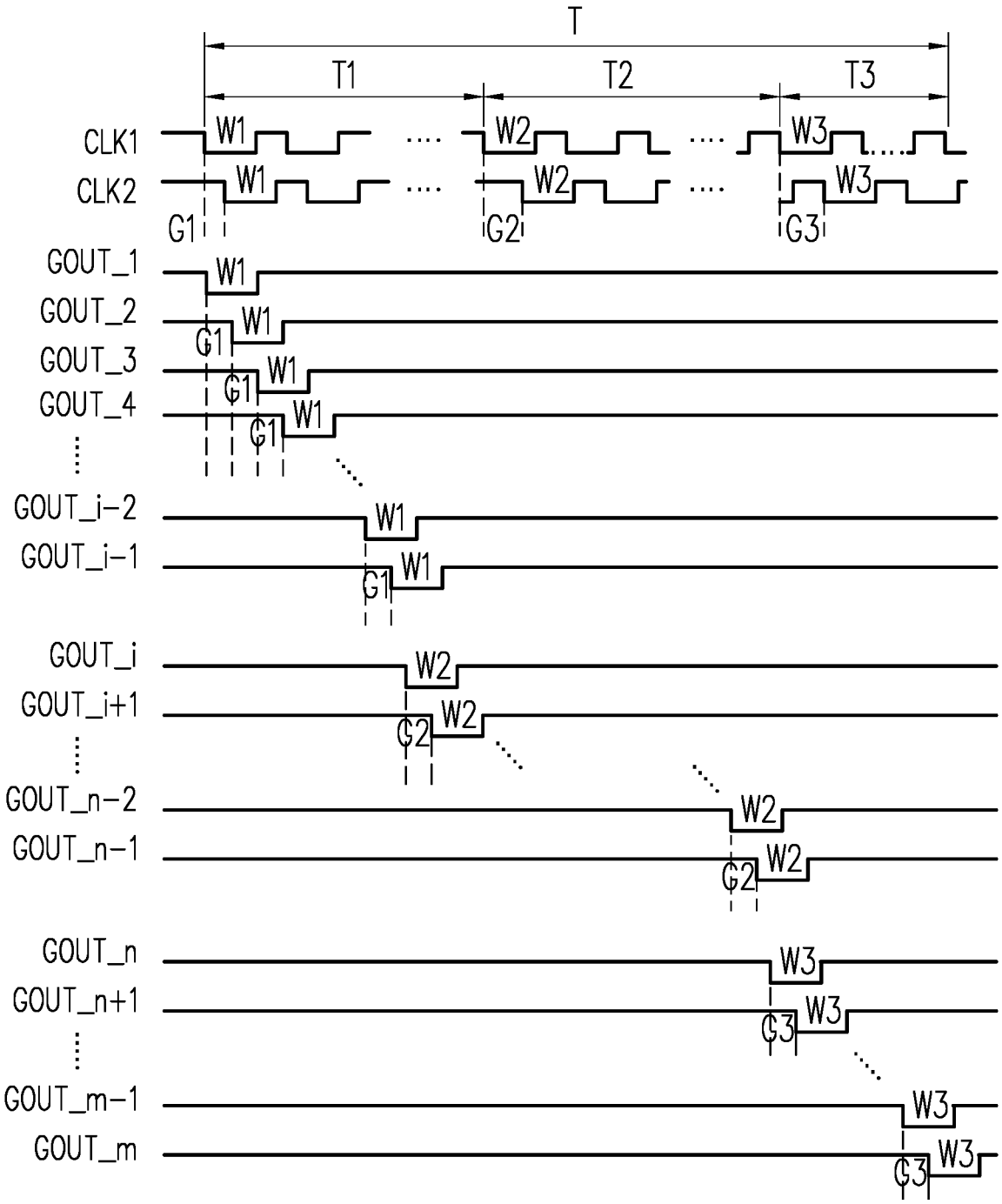
FIG. 8 is a schematic timing diagram illustrating two control clocks and the scan signals (i.e., the gate driving signals) output by the GOA circuit according to yet another embodiment of the invention.

FIG. 8 is a schematic timing diagram illustrating two control clocks and the scan signals (i.e., the gate driving signals) output by the GOA 311 according to yet another embodiment of the invention. In FIG. 8, the horizontal axis represents the time, and the vertical axis represents the signal level. The scan signals GOUT_1 through GOUT_m illustrated in FIG. 8 may be inferred with reference to the descriptions related to GOUT_1 through GOUT_m illustrated in FIG. 6 and FIG. 7 and thus, will not be repeated. According to the embodiment of FIG. 8, the duty cycles and the phase differences of the control clocks are configured to be different for generating different scan signals for controlling the normal display region and the free from display region.

Taking the signal waveform diagram illustrated in FIG. 8 for example, the pulse width of each of the scan signals GOUT_1 through GOUT_i−1 output to the free form display region 322 is W1, the pulse width of each of the scan signals GOUT_i through GOUT_n−1 output to the normal display region 321 is W2, and the pulse width of each of the scan signals GOUT_n through GOUT_m output to another free form display region 322 is W3. The pulse widths W1, W2 and W3 illustrated in FIG. 8 may be inferred with reference to the descriptions related to the pulse widths W1, W2 and W3 illustrated in FIG. 6 and thus, will not be repeated.

Taking the signal waveform diagram illustrated in FIG. 8 for example, the phase differences of the scan signals GOUT_1 through GOUT_i−1 output to the free form display region 322 are G1, the phase difference of each of the scan signals GOUT_i through GOUT_n−1 output to the normal display region 321 is G2, the phase differences of the scan signals GOUT_n through GOUT_m output to another free form display region 322 are G3. In FIG. 6 to FIG. 8, a period T including T1, T2 and T3 indicates a period of outputting control clocks used for generating the scan signals of the entire display panel 320.

Figure 9:
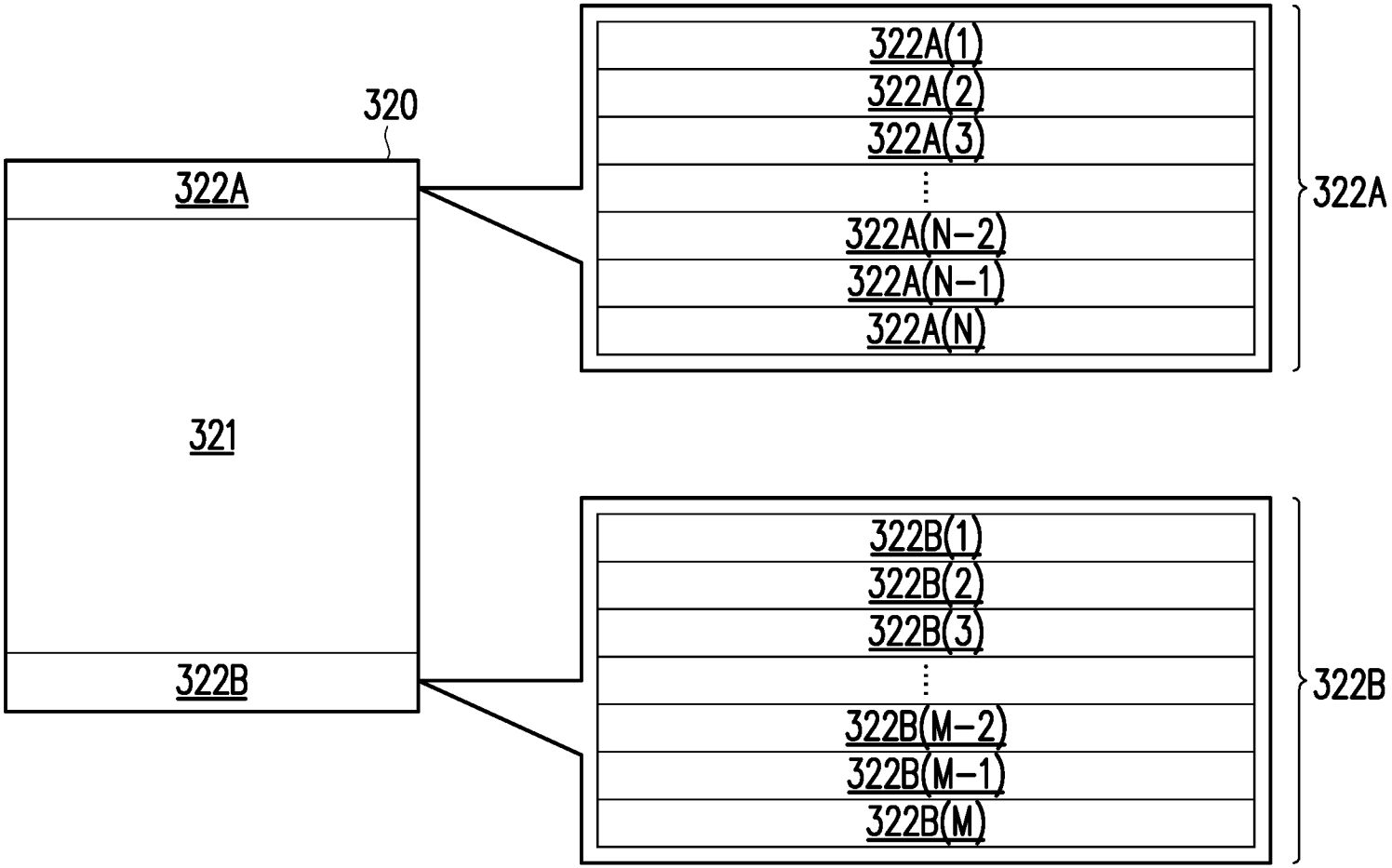
FIG. 9 is a schematic partition diagram illustrating the display region of the display panel according to another embodiment of the invention.

FIG. 9 is a schematic partition diagram illustrating the display region of the display panel 320 according to another embodiment of the invention. The display panel 320, the normal display region 321, the free form display region 322A and the free form display region 322B illustrated in FIG. 9 may be inferred with reference to the descriptions related to the embodiments illustrated in FIG. 3 through FIG. 8 and thus, will not be repeated. In the embodiment illustrated in FIG. 9, in a vertical direction, the free form display region 322A may be divided into a plurality of sub free form display regions 322A(1), 322A(2), 322A(3), . . . , 322A(N-2), 322A(N-1) and 322A(N), and another free form display region 322B may be divided into a plurality of sub free form display regions 322B(1), 322B(2), 322B(3), . . . , 322B(M-2), 322B(M-1) and 322B(M). Based on a design requirement, the number N of the sub free form display regions 322A(1) through 322A(N) and the number M of the sub free form display regions 322B(1) through 322B(M) may be unequal (or equal) to each other. The driving circuit 312 may generate at least one control clock which having a plurality of different duty cycles (represented by pulse width W1-WN) and/or a plurality of different phase differences, such that the GOA circuit 311 generates the scan signals for many sub free form display regions accordingly, thereby compensating the luminance difference between the free form display region 322 and the normal display region 321. Each sub free form display region may include a plurality of display lines.

Figure 10:
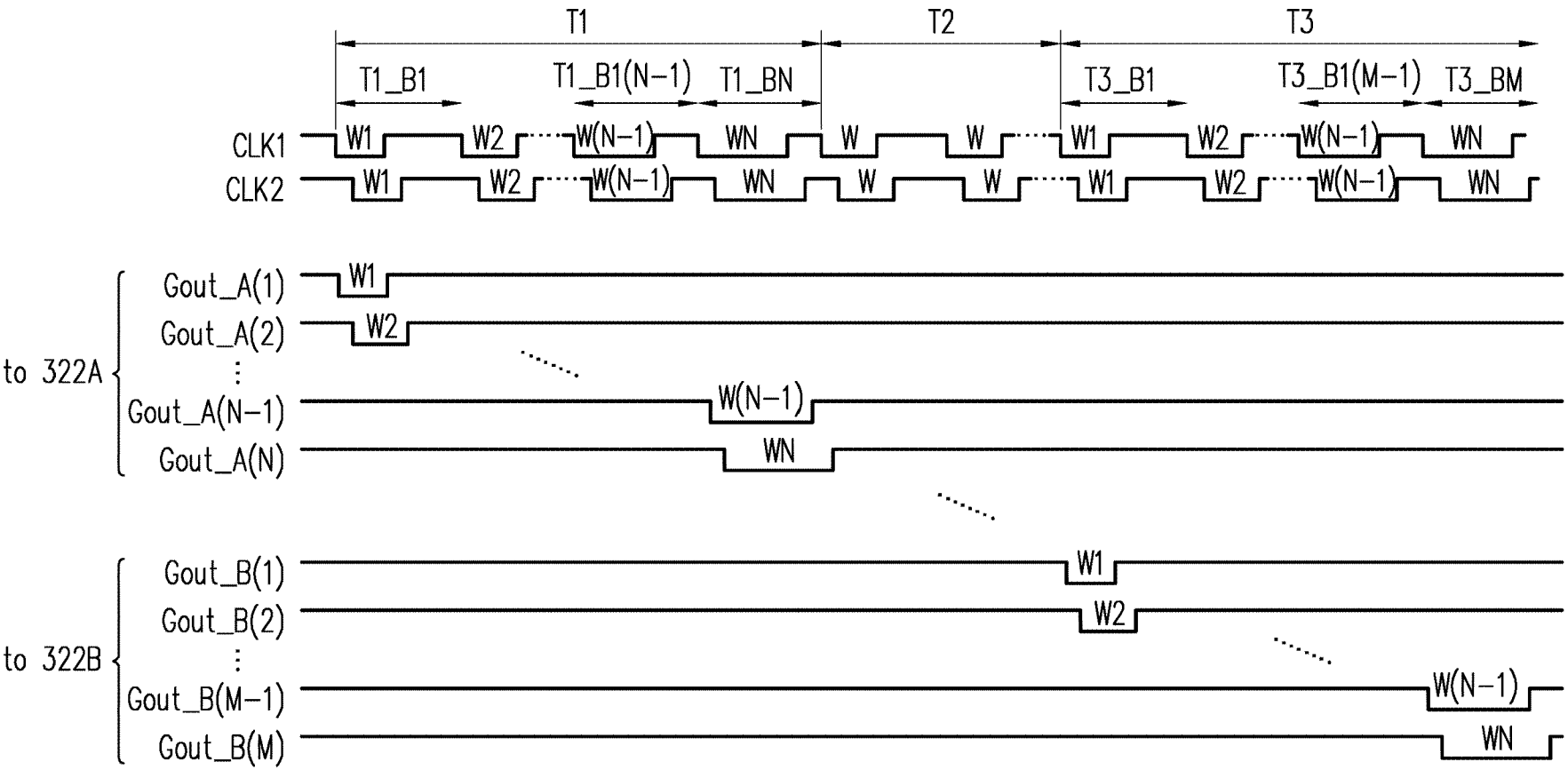
FIG. 10 is a schematic timing diagram illustrating the scan signals (i.e., the gate driving signals) output by the GOA circuit according to yet another embodiment of the invention.

FIG. 10 is a schematic timing diagram illustrating the scan signals (i.e., the gate driving signals) output by the GOA 311 according to yet another embodiment of the invention. Referring to FIG. 9 and FIG. 10, Gout_A(1) illustrated in FIG. 10 represents a scan signal output to the sub free form display region 322A(1) by the GOA 311, and Gout_A(2) illustrated in FIG. 10 represents a scan signal output to the sub free form display region 322A(2) by the GOA 311. By deducing by analogy, Gout_A(N-1) illustrated in FIG. 10 represents a scan signal output to the sub free form display region 322A(N-1) by the GOA 311, and Gout_A(N) illustrated in FIG. 10 represents a scan signal output to the sub free form display region 322A(N) by the GOA 311. Gout_B(1) illustrated in FIG. 10 represents a scan signal output to the sub free form display region 322B(1) by the GOA 311, and Gout_B(2) illustrated in FIG. 10 represents a scan signal output to the sub free form display region 322B(2) by the GOA 311. By deducing by analogy, Gout_B(M-1) illustrated in FIG. 10 represents a scan signal output to the sub free form display region 322B(M-1) by the GOA 311, and Gout_B(M) illustrated in FIG. 10 represents a scan signal output to the sub free form display region 322B(M) by the GOA 311.

Based on the geometric shape in which the free form display region 322 is cut, in the embodiment illustrated in FIG. 10, the pulse widths of the scan signals Gout_A(1) through Gout_A(N) of the sub free form display regions 322A(1) through 322A(N) may be progressively increased or decreased, and/or the pulse widths of the scan signals Gout_B(1) through Gout_B(M) of the sub free form display regions 322B(1) through 322B(M) may be progressively increased or decreased. It should be noted that the curves illustrated in FIG. 10 do not show the phase differences. In actual applications, there are phase differences of the scan signals of the sub free form display regions 322A(1) through 322A(N) and phase differences of the scan signals of the sub free form display regions 322B(1) through 322B(M).

Figure 11:
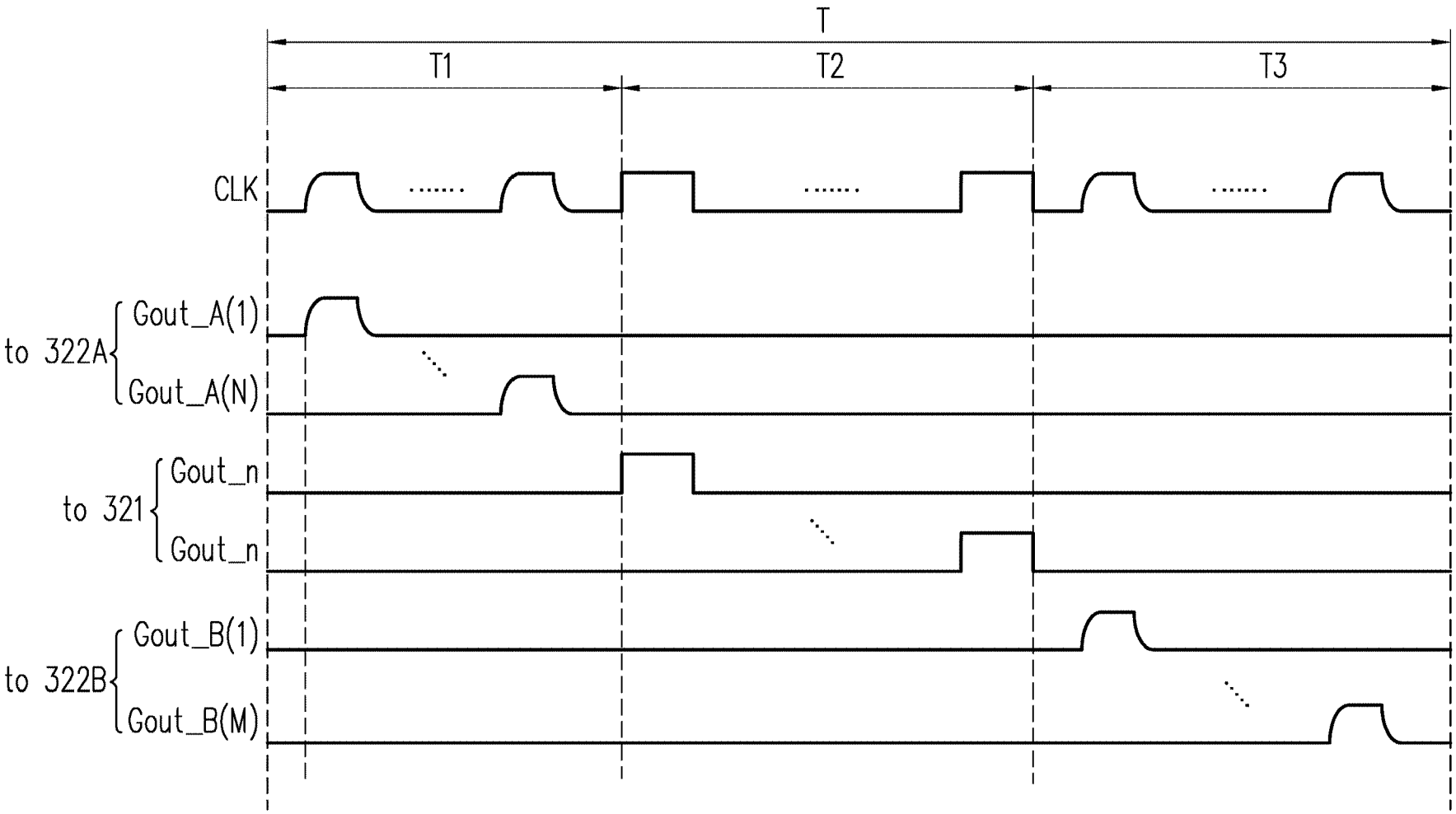
FIG. 11 is a schematic timing diagram illustrating the scan signals output by the GOA circuit according to another embodiment of the invention.

FIG. 11 is a schematic timing diagram illustrating the scan signals output by the GOA 311 according to another embodiment of the invention. In the embodiment illustrated in FIG. 11, the driving circuit 312 may generate at least a control clock CLK having a first driving capability during a period T1, a second driving capability during a period T2 and a third driving capability during a period T3. The first driving capability and the third driving capability are different from the second driving capability, and are used when the control clocks are supplied to generate scan signals of the free form display regions 322A and 322B, thereby compensating the luminance difference between the free form display regions 322A and 322B and the normal display region 321. Anyone of the first driving capability and the third driving capability may be configured to be smaller or larger than the second driving capability based on the loading condition of the free form display region (which may be less or greater than the loading of the normal display region).

Figure 12:
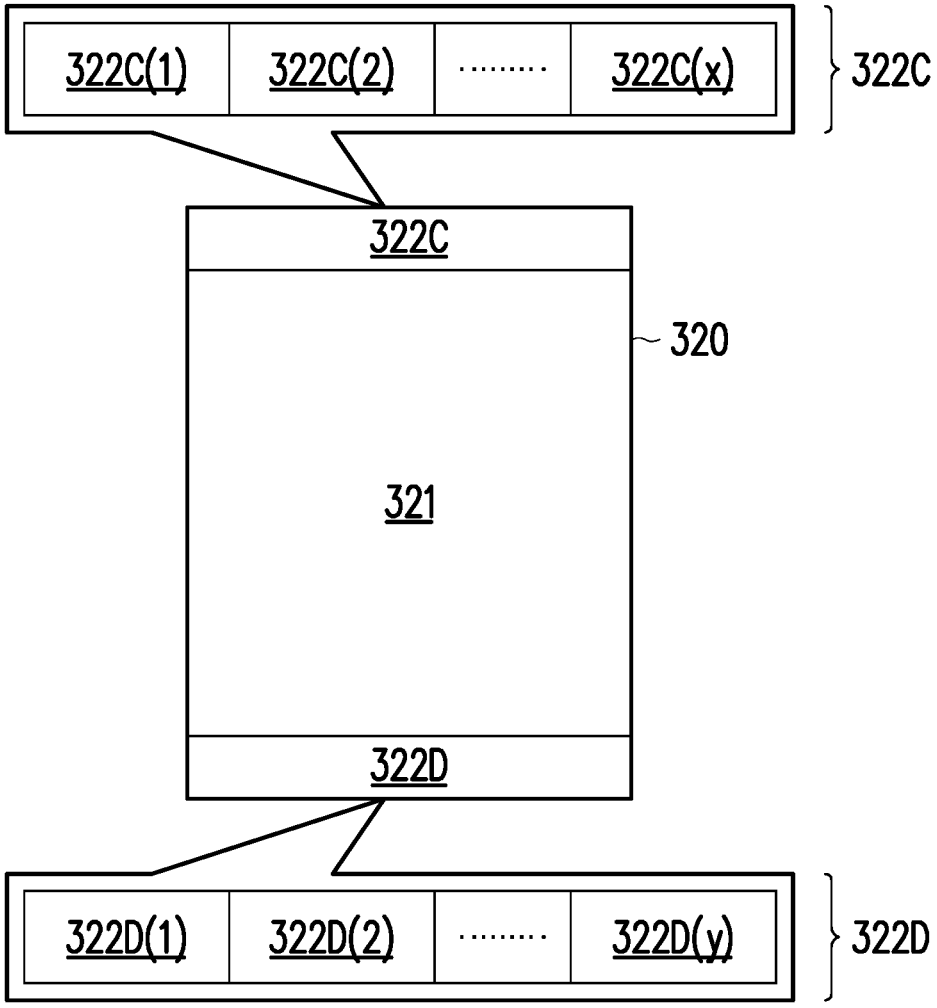
FIG. 12 is a schematic partition diagram illustrating the display region of the display panel according to still another embodiment of the invention.

In this embodiment, the driving capability of the control clock may be response time that the control clock transits states from inactive to active or from active to inactive (wherein in the example of FIG. 11, CLK in high level means active). The faster the response time, the greater driving capability the control clock has. Moreover, referred to FIG. 4, the driving capability of the scan signal SCANi can influence the turn-on period of the transistor T3. Since the driving capability of the control clock can influence the time length that the driving circuit 312 outputs data voltages, the luminance difference between the free form display regions 322 and the normal display region 321 may be compensated by preconfiguring proper driving capabilities of the control clock with respect to the free from display regions. In FIG. 11, Gout_A(1) illustrated in FIG. 11 represents a waveform of a scan signal output to the sub free form display region 322A(1) by the GOA circuit 311. By deducing by analogy, Gout_A(N) illustrated in FIG. 12 represents a waveform of a scan signal output to the sub free form display region 322A(N) by the GOA circuit 311. Gout_n illustrated in FIG. 12 represents a waveform of scan signals output to the normal display region 321 by the GOA circuit 311. Gout_B(1) illustrated in FIG. 12 represents a waveform of a scan signal output to the sub free form display region 322B(1) by the GOA circuit 311. By deducing by analogy, Gout_B(M) illustrated in FIG. 12 represents a waveform of a scan signal output to the sub free form display region 322B(M) by the GOA circuit 311.

FIG. 12 is a schematic partition diagram illustrating the display region of the display panel 320 according to still another embodiment of the invention. The display panel 320, the normal display region 321, the free form display region 322C and the free form display region 322D illustrated in FIG. 12 may be inferred with reference to the descriptions related to the embodiments illustrated in FIG. 3 through FIG. 8 and thus, will not be repeated. In the embodiment illustrated in FIG. 12, in a horizontal direction, the free form display region 322C may be divided into a plurality of sub free form display regions 322C(1), 322C(2), . . . and 322C(x), and another free form display region 322D may be divided into a plurality of sub free form display regions 322D(1), 322D(2), . . . and 322D(y). Each of the free form display regions 322C and 322D include K display lines as an example. Based on a design requirement, the number x of the sub free form display regions 322C(1) through 322C(x) and the number y of the sub free form display regions 322D(1) through 322D(y) may be unequal (or equal) to each other. For generating scan signals of each sub free form display region of FIG. 12, a dedicated control clock group for each sub free form display region is required.

Figure 13:
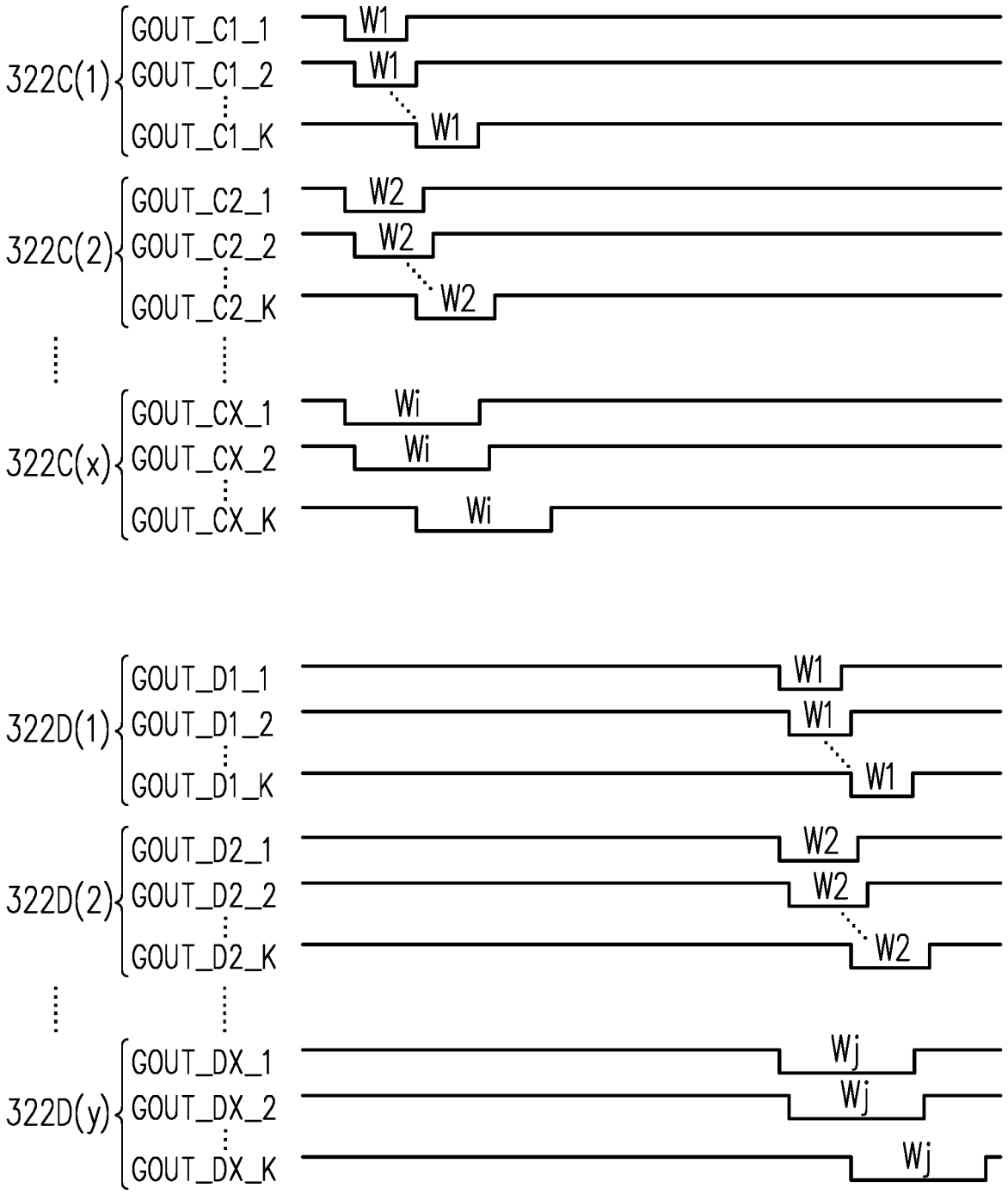
FIG. 13 is a schematic timing diagram illustrating the scan signals output by the GOA circuit according to another embodiment of the invention.

For example, FIG. 13 is a schematic timing diagram illustrating the scan signals output by the GOA according to another embodiment of the invention. Referring to FIG. 12 and FIG. 13, the scan signals (GOUT_C1_1 to GOUT_C1_K) of the sub free form display region 322C(1) may be generated according to a first control clock group including clocks such as CLK1 and CLK2 of FIGS. 6-8, and scan signals (GOUT_C2_1 to GOUT_C2_K) of the sub free form display region 322C(2) may be generated according to a second control clock group including another clocks separate from the second control clock group. To implement the embodiment of FIG. 12 and FIG. 13, scan lines (for transmitting SCANi) of one sub free form display region may be physically separated from scan lines of another sub free form display region.

Figure 14A:
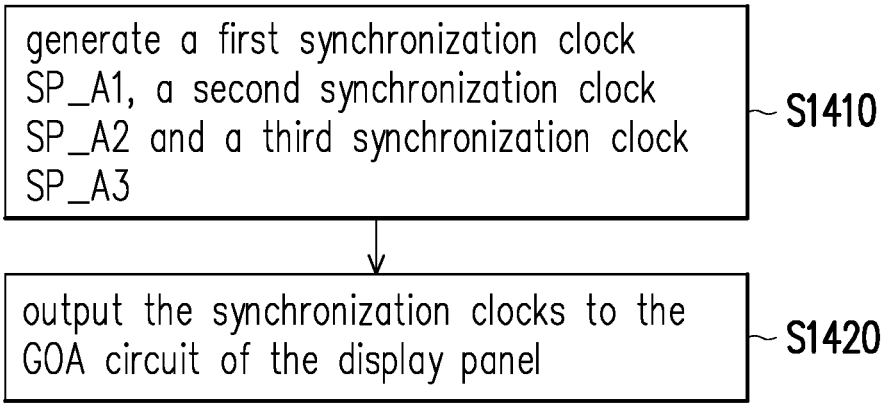
FIG. 14A is a flowchart illustrating a driving method of a driving circuit according to an embodiment of the invention.
Figure 14B:
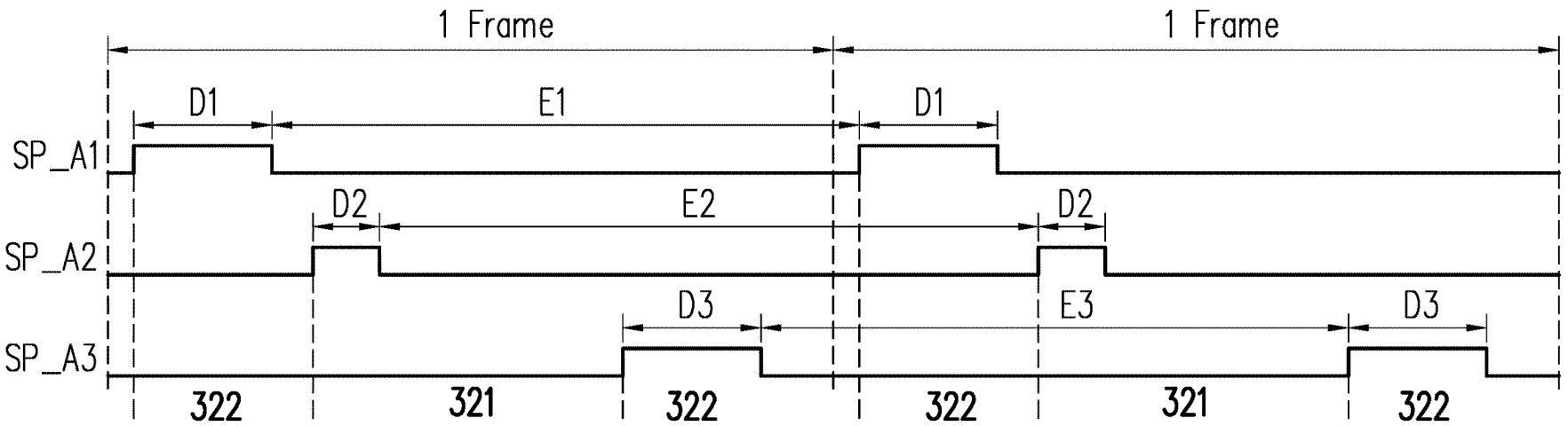
FIG. 14B is a schematic timing diagram illustrating the emitting control signals (i.e., the driving signals) output by the GOA according to yet another embodiment of the invention.

FIG. 14A is a flowchart illustrating a driving method of a driving circuit according to an embodiment of the invention. The driving method of FIG. 14A may be implemented in the driving circuit 312 and thereby the following is described in view of the driving circuit 312. Also referred to FIG. 14B, which is a schematic timing diagram illustrating the synchronization signals output by the GOA circuit 311 according to yet another embodiment of the invention. In FIG. 14B, the horizontal axis represents the time, and the vertical axis represents the signal level. Ins step S1410, the driving circuit 312 (and more specifically, the timing control circuit of the driving circuit 312) may generate a first synchronization clock SP_A1 having a first duty cycle, a second synchronization clock SP_A2 having a second duty cycle and a third synchronization clock SP_A3 having a third duty cycle to be transmitted to the GOA circuit 311 disposed on the display panel 320. Each of these synchronization clocks is a periodical pulse. The periods of the first, second and third synchronization clocks SP_A1 to SP_A3 are the same as a frame period, and the pulses of the first, second and third synchronization clocks SP_A1 to SP_A3 starts at different times in order to indicate the respective beginning of generating scan signals of each display region. The duty cycle of the synchronization clock may be determined according to the pulse width (which may be preconfigured by using registers. Since a period between every two pulses is an emitting period of OLED emitting, the OLED emitting period of the free form display regions can be configured to be different from the OLED emitting period of the normal display region by configuring different duty cycles for synchronization clocks. In step S1420, the driving circuit 312 may output the synchronization clocks to the GOA circuit 311 of the display panel 320. The GOA circuit 311 may generate a first plurality of scan signals according to the first synchronization clock SP_A1 so as to control the upper free form display region 322, generate a second plurality of scan signals according to the second synchronization clock SP_A2 so as to control the normal display region 321, and generate a third plurality of scan signals according to the third synchronization clock SP_A3 so as to control the lower free form display region 322. As a result, a luminance difference between the normal display region and the free form display regions is reduced.

Taking the signal waveform diagram illustrated in FIG. 14B for example, the pulse width of the first synchronization clock SP A1 output to the free form display region 322 is D1 (where an emitting period of the OLEDs is E1), the pulse width of the second synchronization clock SP_A2 output to the normal display region 321 is D2 (where an emitting period of the OLEDs is E2), and the pulse width of the third synchronization clock SP_A3 output to the lower free form display region 322 is D3 (where an emitting period of the OLEDs is E3). The pulse width D1, the pulse width D2 and the pulse width D3 may be determined based on a design requirement, and the pulse widths A1 and A3 are different from the pulse width A2.

For example, in the condition that the full screen has the data corresponding to the same grayscale, the luminance of the free form display region 322 may be much greater than the luminance of the normal display region 321. In this condition, based on the control and adjustment of the driving circuit 310, the pulse widths D1 and D3 of the synchronization clocks SP_A1 and SP_A3 output to the free form display region 322 may be greater than the pulse width D2 of the synchronization clocks SP_A2 output to the normal display region 321. Namely, the emitting periods E1 and E3 of the free form display region 322 may be shorter than the emitting period E2 of the normal display region 321. Thus, the luminance of the free form display region 322 may be reduced to be close to the luminance of the normal display region 321. In other words, the driving circuit 312 is capable of compensating the luminance difference between the free form display region 322 and the normal display region 321.

Figure 15A:
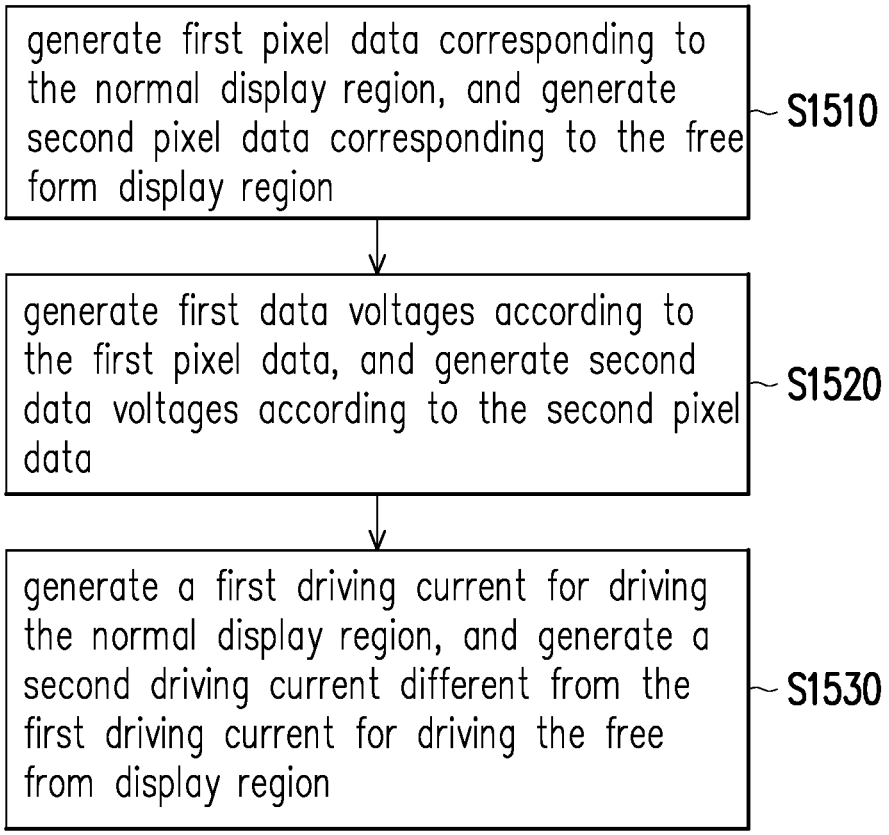
FIG. 15A is a flowchart illustrating a driving method of a driving circuit according to an embodiment of the invention.
Figure 15B:
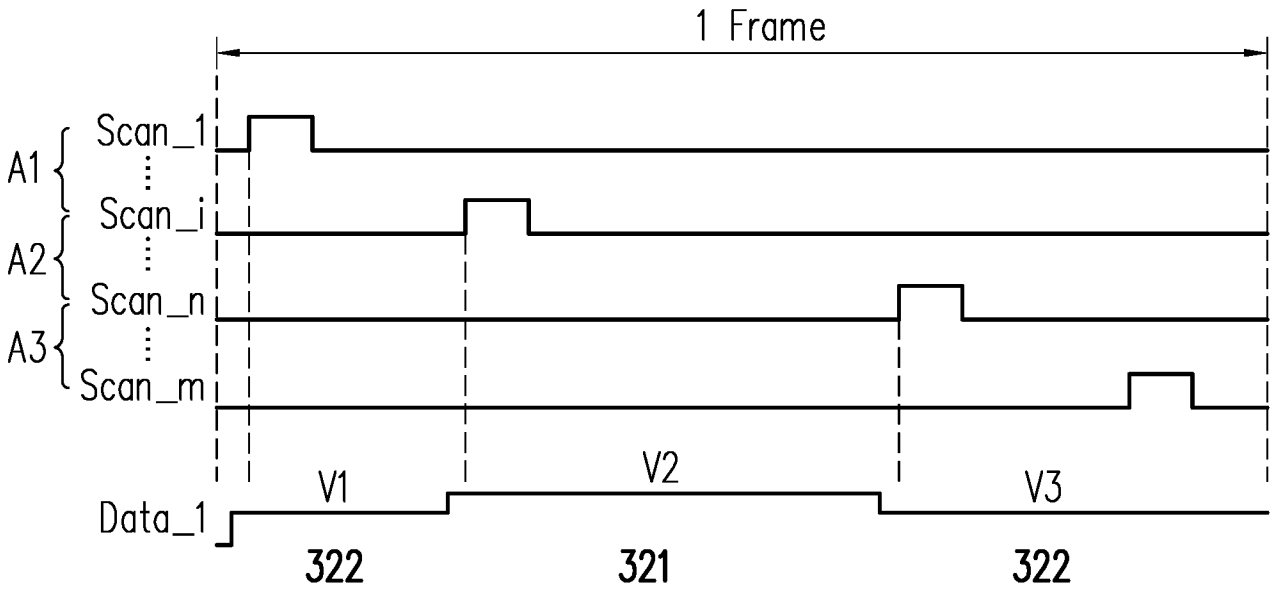
FIG. 15B is a schematic timing diagram illustrating the data voltages (i.e., the driving signals) output by the driving circuit according to an embodiment of the invention.

FIG. 15A is a flowchart illustrating a driving method of a driving circuit according to an embodiment of the invention. The driving method of FIG. 15A may be implemented in the driving circuit 312 and thereby the following is described in view of the driving circuit 312. Also referred to FIG. 15B, FIG. 15B is a schematic waveform diagram illustrating the data voltages (i.e., the data driving signals) output by the driving circuit 312 according to an embodiment of the invention. In FIG. 15B, the horizontal axis represents the time, and the vertical axis represents the signal level. In step S1510, the driving circuit 312 (and more specifically, the timing control circuit of the driving circuit 312) may generate first pixel data corresponding to the normal display region (the first display region) and generate second pixel data corresponding to the free form display region (the second display region). The first pixel data are a plurality of pixel data corresponding to display lines of the normal display region, and the second pixel data are a plurality of pixel data corresponding to display lines of the free form display region. The timing control circuit may output the first pixel data and the second pixel data to the data driving circuit in the driving circuit 312. The driving circuit 312 (and more specifically, the data driving circuit of the driving circuit 312) may perform step S1520 or step S1530 to reduce a luminance difference between the normal display region and the free form display region. In step S1520, the driving circuit 312 may generate first data voltages according to the first pixel data and generate second data voltages according to the second pixel data, wherein the second data voltages are being compensated by the data driving circuit, or the second pixel data are being compensated by the timing control circuit before the second pixel data are output to the data driving circuit of the driving circuit 312. The plurality of data voltages for driving the free form display region may be generated by a compensation process, such as using a different gamma curve to generate gamma voltages. Step S1530 is performed based on a specific display region partition illustrated in FIG. 16. In step S1530, the driving circuit 312 may generate a first driving current (first driving capability) for driving the normal display region and generate a second driving current (second driving capability) different from the first driving current for driving the free from display region. The first driving current and the second driving current in this embodiment are driving current output via data output channel corresponding to different display regions partitioned in a horizontal direction.

A resultant waveform of a data voltage Data_1 generated by performing step S1520 is shown in FIG. 15B. Data_1 illustrated in FIG. 15B represents a waveform of a data output channel of the driving circuit 312, which sequentially outputs data voltages to the display panel 320. Scan_1 to Scan m illustrated in FIG. 15B represent scan signals output to the display panel. V1, V2, V3 illustrated in FIG. 15 represents data voltages in the upper free form display region 322, the normal display region 321, and the lower free form display region 322. Each of the voltages V1, V2 and V3 corresponds to the same grayscale (i.e., the same grayscale data), which shows the data voltages for the free form display regions 322 are being compensated. The voltages V1 and V3 in the free form display region 322 are different from the voltage V2 corresponding to the data voltage Data_1 in the normal display region 321, thereby reducing the luminance difference between the normal display region 321 and the free form display region 322.

For example, in a conventional condition that the full screen has the data corresponding to the same grayscale, the luminance of the free form display region may be much greater than the luminance of the normal display region. By using the driving method of FIG. 15A, the voltages V1 and V3 output to the free form display region 322 may be lower than the voltage V2 output to the normal display region 321 even though V1, V2 and V3 are corresponding to the same grayscale. Thus, the luminance of the free form display region 322 may be reduced to be close to the luminance of the normal display region 321.

Figure 16:
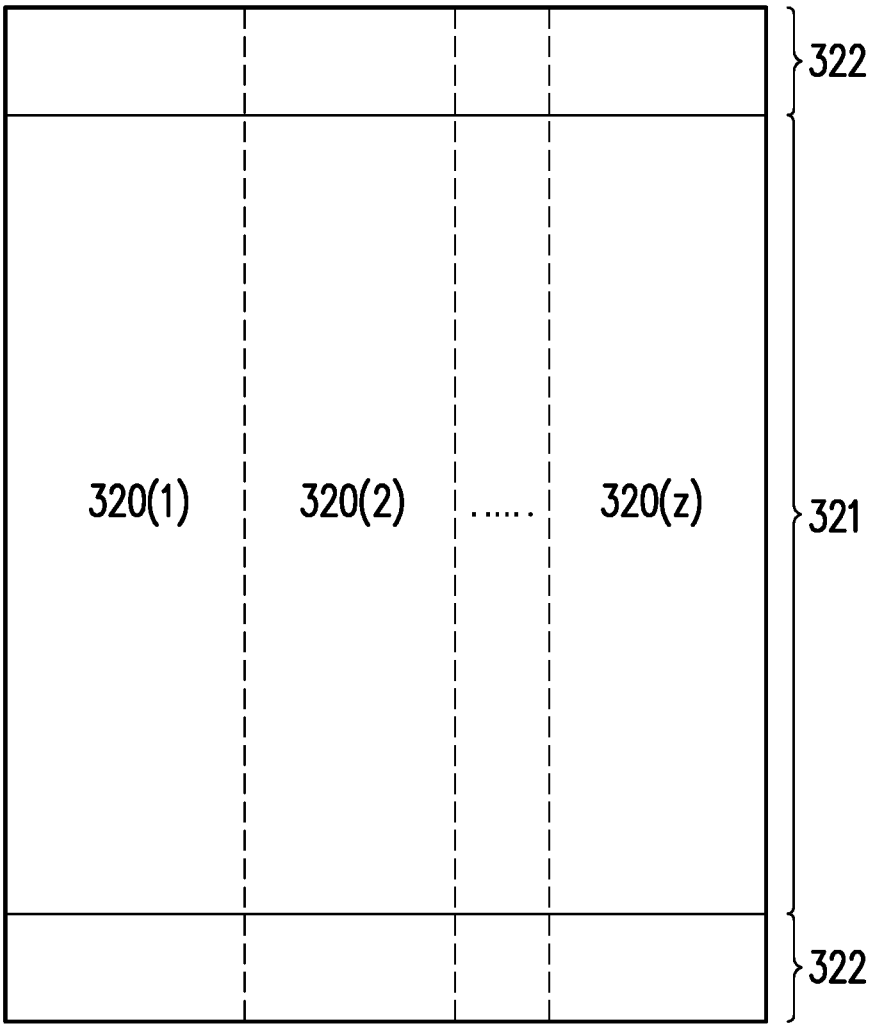
FIG. 16 is a schematic partition diagram illustrating the display region of the display panel according to further another embodiment of the invention.

FIG. 16 is a schematic partition diagram illustrating the display region of the display panel 320 according to further another embodiment of the invention. The normal display region 321 and the free form display region 322 illustrated in FIG. 16 may be inferred with reference to the descriptions related to the embodiments illustrated in FIG. 3 through FIG. 8 and thus, will not be repeated. In the embodiment illustrated in FIG. 16, in a horizontal direction, the display panel 320 may be divided into a plurality of sub display regions 320(1), 320(2), . . . and 320(*z*). The number z of the sub display regions 320(1) through 320(*z*) may be determined based on a design requirement.

Figure 17:
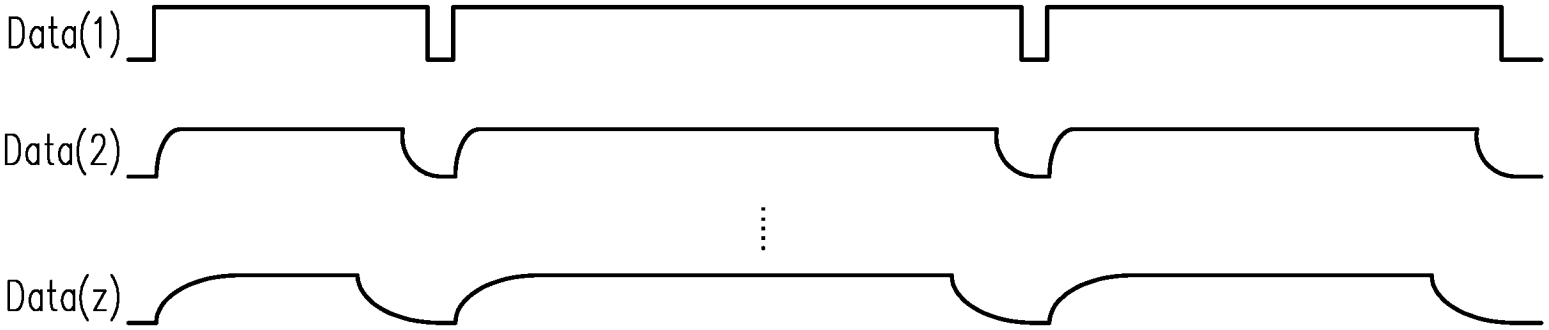
FIG. 17 is a schematic waveform diagram illustrating the data voltages (i.e., the driving signals) output by the driving circuit according to yet another embodiment of the invention.

The driving circuit 312 may adjust a driving capability for outputting the data voltages to the sub display regions 320(1) through 320(*z*). FIG. 17 is a schematic waveform diagram illustrating the data voltages (i.e., the driving signals) output by the driving circuit 312 according to yet another embodiment of the invention. Referring to FIG. 3, FIG. 16 and FIG. 17, in FIG. 17, the horizontal axis represents the time, and the vertical axis represents the signal level. Data(1) illustrated in FIG. 17 represents a waveform of one of the data voltages output to the sub display region 320(1) by the driving circuit 312. Data(2) illustrated in FIG. 17 represents a waveform of one of the data voltages output to the sub display region 320(2) by the driving circuit 312. By deducing by analogy, Data(z) illustrated in FIG. 17 represents a waveform of one of the data voltages output to the sub display region 320(*z*) by the driving circuit 312. In the embodiment illustrated in FIG. 17, based on the geometric shape in which the free form display region 322 is cut, the drive capabilities of the data voltages (i.e., the driving signals) in the sub areas 320(1) through the sub area 320(*z*) are progressively decreased. In other embodiments, the drive capabilities (i.e. driving currents) of the data voltages in the sub display region 320(1) through the sub display region 320(*z*) may be progressively increased.

Based on different design requirements, the blocks of the GOA 311 and/or the driving circuit 312 may be implemented in a form of hardware and/or firmware. The blocks of the GOA 311 and/or the driving circuit 312 may be implemented as logic circuits on an integrated circuit. Functions related to the GOA 311 and/or the driving circuit 312 may be implemented in a form of hardware by employing hardware description languages (e.g., Verilog HDL or VHDL) or other suitable programming languages. For example, the functions related to the GOA 311 and/or the driving circuit 312 may be implemented as a variety of logic blocks, modules and circuits in one or more controllers, microcontrollers, microprocessors, application-specific integrated circuits (ASICs), digital signal processors (DSPs), field programmable gate arrays (FPGAs) and/or other processing units.

In light of the foregoing, the display and the driving method thereof provided by the embodiments of the invention can achieve compensating the luminance difference between the free form display region and the normal display region. Thus, the display provided by the embodiments of the invention can degrade the luminance difference between the normal display region and the free form display region in the same display panel.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A driving circuit for driving a display panel comprising a plurality of regions, including a rectangular display region and a free-form display region, the driving circuit comprising:

a timing control circuit, for generating at least one first control clock having a first phase difference during a first period and having a second phase difference different from the first phase difference during a second period, or for generating at least one second control clock having a first driving capability during the first period and having a second driving capability different from the first driving capability during the second period, wherein a luminance difference between the rectangular display region and the free-form display region is reduced by using the at least one first control clock having the first phase difference during the first period to control a first luminance of the rectangular display region and using the at least one first control clock having the second phase difference during the second period to control a second luminance of the free-form display region; or the luminance difference between the rectangular display region and the free-form display region is reduced by using the at least one second control clock having the first driving capability during the first period to control the first luminance of the rectangular display region and using the at least one second control clock having the second driving capability during the second period to control the second luminance of the free-form display region, wherein the at least one first control clock is configured to be transmitted to a gate driving circuit disposed on the display panel for generating a first plurality of scan signals controlling the rectangular display region and generating a second plurality of scan signals controlling the free-form display region according to the at least one first control clock; or the at least one second control clock is configured to be transmitted to the gate driving circuit disposed on the display panel for generating the first plurality of scan signals controlling the rectangular display region and generating the second plurality of scan signals controlling the free-form display region according to the at least one second control clock.

2. The driving circuit according to claim 1, wherein each of the first and the second phase differences are a difference between two control clocks, and the second phase difference is larger or smaller than the first phase difference.

3. The driving circuit according to claim 1, wherein the second driving capability is larger or smaller than the first driving capability.

4. A display apparatus, comprising:

a display panel, comprising a plurality of regions including a rectangular display region and a free-form display region;

a gate driving circuit disposed on the display panel and configured to generate a first plurality of scan signals controlling the rectangular display region and a second plurality of scan signals controlling the free-form display region according to at least one first control clock or according to at least one second control clock; and a driving chip, coupled to the display panel and the gate driving circuit, and configured to generate the at least one first control clock having a first phase difference during a first period and having a second phase difference different from the first phase difference during a second period, or generate the at least one second control clock having a first driving capability during the first period and having a second driving capability different from the first driving capability during the second period, wherein a luminance difference between the rectangular display region and the free-form display region is reduced by using the at least one first control clock having the first phase difference during the first period to control a first luminance of the rectangular display region and using the at least one first control clock having the second phase difference during the second period to control a second luminance of the free-form display region; or the luminance difference between the rectangular display region and the free-form display region is reduced by using the at least one second control clock having the first driving capability during the first period to control the first luminance of the rectangular display region and using the at least one second control clock having the second driving capability during the second period to control the second luminance of the free-form display region.

5. The display apparatus according to claim 4, wherein each of the first and the second phase differences are a difference between two control clocks, and the second phase difference is larger or smaller than the first phase difference.

6. The display apparatus according to claim 4, wherein the second driving capability is larger or smaller than the first driving capability.

7. A driving method for driving a display panel comprising a plurality of regions, including a first rectangular display region and a free-form display region, the driving method comprising:

generating at least one first control clock having a first phase difference during a first period and having a second phase difference different from the first phase difference during a second period, or generating at least one second control clock having a first driving capability during the first period and having a second driving capability different from the first driving capability during the second period, wherein a luminance difference between the rectangular display region and the free-form display region is reduced by using the at least one first control clock having the first phase difference during the first period to control a first luminance of the rectangular display region and using the at least one first control clock having the second phase difference during the second period to control a second luminance of the free-form display region; or the luminance difference between the rectangular display region and the free-form display region is reduced by using the at least one second control clock having the first driving capability during the first period to control the first luminance of the rectangular display region and using the at least one second control clock having the second driving capability during the second period to control the second luminance of the free-form display region, wherein the at least one first control clock_is configured to be transmitted to a gate driving circuit disposed on the display panel for generating a first plurality of scan signals controlling the rectangular display region and generating a second plurality of scan signals controlling the free-form display region according to the at least one first control clock; or the at least one second control clock is configured to be transmitted to the gate driving circuit disposed on the display panel for generating the first plurality of scan signals controlling the rectangular display region and generating the second plurality of scan signals controlling the free-form display region according to the at least one second control clock.

8. The driving method according to claim 7, wherein each of the first and the second phase differences are a difference between two control clocks, and the second phase difference is larger or smaller than the first phase difference.

9. The driving method according to claim 7, wherein the second driving capability is larger or smaller than the first driving capability.

10. A driving circuit for driving a display panel comprising a plurality of regions, including a rectangular display region and a free-form display region, the driving circuit comprising:

a timing control circuit, for generating a first synchronization clock having a first duty cycle and a second synchronization clock having a second duty cycle to be transmitted to a gate driving circuit disposed on the display panel, wherein a luminance difference between the rectangular display region and the free-form display region is reduced by using a first plurality of scan signals generated by the first synchronization clock to control a first luminance of the rectangular display region, and using a second plurality of scan signals generated by the second synchronization clock to control a second luminance of the free-form display region.

11. The driving circuit according to claim 10, wherein a period of the first synchronization clock and a period of the second synchronization clock are the same as a frame period and an active period of the first synchronization clock and an active period of the second synchronization clock are not synchronized.

12. A driving method for driving a display panel comprising a plurality of regions, including a rectangular display region and a free-form display region, the driving method comprising:

generating a first synchronization clock having a first duty cycle and a second synchronization clock having a second duty cycle to be transmitted to a gate driving circuit disposed on the display panel, wherein a luminance difference between the rectangular display region and the free-form display region is reduced by using a first plurality of scan signals generated by the first synchronization clock to control a first luminance of the rectangular display region, and using a second plurality of scan signals generated by the second synchronization clock to control a second luminance of the free-form display region.

13. The driving method according to claim 12, wherein a period of the first synchronization clock and a period of the second synchronization clock are the same as a frame period and an active period of the first synchronization clock and an active period of the second synchronization clock are not synchronized.

14. A driving circuit for driving a display panel comprising a plurality of regions, including a rectangular display region and a free-form display region, the driving circuit comprising:

a timing control circuit, for generating first pixel data corresponding to the rectangular display region and generating second pixel data corresponding to the free-form display region; and a data driving circuit, coupled to the timing control circuit, wherein the data driving circuit is configured to:

generate first data voltages according to the first pixel data and generate second data voltages according to the second pixel data; or generate a first driving current for driving the rectangular display region and generate a second driving current different from the first driving current for driving the free-form display region, wherein a luminance difference between the rectangular display region and the free-form display region is reduced by using the data driving circuit to compensate the second data voltages associated with the free-form display region; or the luminance difference between the rectangular display region and the free-form display region is reduced by using the first driving current to drive the rectangular display region and using the second driving current to drive the free-form display region.

15. A driving method for driving a display panel comprising a plurality of regions, including a rectangular display region and a free-form display region, the driving method comprising:

generating first pixel data corresponding to the rectangular display region and generating second pixel data corresponding to the free-form display region; and performing one of the following, so as to reduce a luminance difference between the rectangular display region and the free-form display region:

(1) generating first data voltages according to the first pixel data and generating second data voltages according to the second pixel data, and using a data driving circuit to compensate the second data voltages associated with the free-form display region; and (2) generating a first driving current for driving the first rectangular display region and generating a second driving current different from the first driving current for driving the free-form display region.

* * * * *